US010864430B2

(12) United States Patent
Dumas

(10) Patent No.: US 10,864,430 B2
(45) Date of Patent: Dec. 15, 2020

(54) TRUCK CARRYING ADAPTER FOR SKATEBOARD

(71) Applicant: D&D Broadcast Inc., San Pedro, CA (US)

(72) Inventor: Patrick Lee Dumas, San Pedro, CA (US)

(73) Assignee: D&D Broadcast Inc., San Pedro, CA (US)

( * ) Notice: Subject to any disclaimer, the term of this patent is extended or adjusted under 35 U.S.C. 154(b) by 48 days.

(21) Appl. No.: 16/047,951

(22) Filed: Jul. 27, 2018

(65) Prior Publication Data

US 2019/0030416 A1 Jan. 31, 2019

Related U.S. Application Data

(63) Continuation-in-part of application No. 29/658,107, filed on Jul. 27, 2018, now Pat. No. Des. 865,097.

(60) Provisional application No. 62/538,595, filed on Jul. 28, 2017.

(51) Int. Cl.
*A63C 17/01* (2006.01)
*A63C 17/00* (2006.01)

(52) U.S. Cl.
CPC ..... *A63C 17/011* (2013.01); *A63C 17/0046* (2013.01); *A63C 17/012* (2013.01); *A63C 17/015* (2013.01); *A63C 17/017* (2013.01)

(58) Field of Classification Search
CPC ... A63C 17/011; A63C 17/012; A63C 17/015; A63C 17/017; A63C 17/0046
See application file for complete search history.

(56) References Cited

U.S. PATENT DOCUMENTS

| | | | |
|---|---|---|---|
| 5,522,620 | A | 6/1996 | Pracas |
| 6,793,224 | B2 | 9/2004 | Stratton |
| 6,979,007 | B1 | 12/2005 | Hosoda |
| 7,287,762 | B2 | 10/2007 | Stratton |
| 7,810,825 | B2 | 10/2010 | Cole |
| 7,828,306 | B2 | 11/2010 | Stratton |

(Continued)

FOREIGN PATENT DOCUMENTS

| | | |
|---|---|---|
| WO | 2001/060467 | 8/2001 |

OTHER PUBLICATIONS

European Search Report for Application No. EP 19186382, dated Jan. 9, 2020, 9 pages.

(Continued)

*Primary Examiner* — Bryan A Evans
(74) *Attorney, Agent, or Firm* — Fish IP Law, LLP

(57) ABSTRACT

Apparatus, systems, and methods in which a truck carrying member, for coupling a conventional truck to a skateboard, comprises a pivoting plate and optionally a base plate. For example, the base and pivoting plates are rotatably coupled at a pivot comprising an elastic flexible member that biases the pivoting plate to a default position (e.g., center of the base plate). Preferably, the base plate and pivoting plate each has a mounting surface and a pivoting surface that form an obtuse angle, such that the mounting surface of the pivoting surface extends downward. Another example of a pivoting plate comprises flexible members that allow the pivoting plate to tilt relative to the skateboard.

19 Claims, 40 Drawing Sheets

(56) References Cited

U.S. PATENT DOCUMENTS

| | | | | |
|---|---|---|---|---|
| 2013/0175774 | A1* | 7/2013 | Lininger, Jr. ..... | A63C 17/0033 280/11.27 |
| 2015/0097352 | A1* | 4/2015 | Ivazes ..... | A63C 17/012 280/124.175 |
| 2018/0193721 | A1 | 7/2018 | Martinez Almansa et al. | |

OTHER PUBLICATIONS

"Carver C7 Truck," Carver Skateboards Online Shop, [retrieved on Apr. 14, 2020]<URL: https://shop.carverskateboards.com/collections/trucks/products/carver-c7-truck>, 2 pages.
"Smoothstar Thursters," [retrieved on Apr. 14, 2020, <URL: https://smoothstar.com.au/product-category/smoothstar-thrusters/>, 9 page.
"Yow System", [retrieved on Apr. 14, 2020], <URL: https://yowsurf.com/yow-system/>, 4 page.

* cited by examiner

TRUCK CARRYING ADAPTER FOR SKATEBOARD

This application claims priority under 35 U.S.C. 119(e) of U.S. Provisional Patent Application Ser. No. 62/538,595, titled "TRUCK CARRYING MEMBER FOR SKATEBOARD" by the same inventor, filed on Jul. 28, 2017. This application also claims priority and is a continuation in part of U.S. Design application Ser. No. 29/658,107, titled "TRUCK CARRYING ADAPTER" by the same inventor, filed on Jul. 27, 2018. These and all other referenced extrinsic materials are incorporated herein by reference in their entirety. Where a definition or use of a term in a reference that is incorporated by reference is inconsistent or contrary to the definition of that term provided herein, the definition of that term provided herein is deemed to be controlling.

FIELD OF THE INVENTION

The field of the invention is skateboard trucks, more specifically, truck carrying members for improving the movement of conventional trucks.

BACKGROUND

The background description includes information that may be useful in understanding the present invention. It is not an admission that any of the information provided herein is prior art or relevant to the presently claimed invention, or that any publication specifically or implicitly referenced is prior art.

Skateboards have been around for a long time and different riders have introduced different riding styles over the years. Today's skateboard riders desire an enhanced performance with respect to maneuverability over traditional skateboard configurations. Unfortunately, traditional skateboard trucks are designed for street skating and aerial tricks, and do not provide enhanced maneuverability for a superior riding experience.

Some have attempted to redesign traditional skateboards by providing a dual pivot truck with side-to-side movement. For example, U.S. Pat. No. 5,522,620 to Pracas titled "Truck For A Rideable Vehicle, Such As A Skateboard" teaches a truck design that has a second pivotal member to allow for "to and fro type swinging motion." Col. 4, line 46. While the additional axis in Pracas provides another degree of freedom, the plane of rotation is parallel to the direction of motion (i.e., deck). This design makes it difficult to control the board especially during extreme turns or at high speeds, since it does not provide a centering (i.e., biasing) mechanism. In addition, the truck is incompatible with an existing conventional truck, because the second axis is built into the truck. It would be advantageous to provide an adapter that can be used with a conventional truck and enhances its function by having a centering mechanism.

As another example, U.S. Pat. No. 6,793,224 to Stratton titled "Truck for Skateboards" tries to simulate the dynamics of a surfboard with a skateboard truck with a centering mechanism. Col. 2, line 3. Unlike Pracas, the second axis of rotation is "oblique to the direction of motion." Col. 6, line 12. However, like Pracas, the second axis of rotation is built-into the truck and therefore cannot be used on an existing conventional truck. Moreover, the centering mechanism in Stratton is overly complex and requires numerous parts, including a spring-loaded link, a link pin, and a heavy-duty compression spring. Col. 7, lines 45-50. The complex design is not durable and fails to provide a natural and smooth transition between turns.

Thus, there is still a need for a skateboard truck adaptor that can be used with a conventional truck and has a simple and durable design to improve the maneuverability of the skateboard and provide a more comfortable and enjoyable riding experience.

All publications identified herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

SUMMARY OF THE INVENTION

The present inventive subject matter provides apparatus, systems, and methods in which a truck carrying member, for coupling a conventional truck to a skateboard, increases the maneuverability of a skateboard by allowing the skateboard to turn and tilt while providing a centering mechanism with smooth transitions between turns.

In some embodiments of the current invention, the truck carrying member comprises a pivoting plate rotatably coupled with a base plate at a pivot. The base plate is coupled with the skateboard deck, while the pivoting plate is coupled with a truck. The pivot comprises an elastic flexible member coupled with both the pivoting plate and the base plate. Due to the elasticity of the flexible member, the pivoting plate resists rotation with respect to base plate and automatically returns to a default position after rotation (e.g., center). In preferred embodiments, the resistance increases exponentially as the pivoting plate turns, which gives the rider more control of the skateboard.

The flexible member can be of any suitable shape, but preferably the shape of a bushing with a non-cylindrical cross-section that functions as a mechanical lock. The non-cylindrical design does not allow the pivoting plate to rotate without causing a shape change in the flexible member. In preferred embodiments, the flexible member is sufficiently flexible to allow the pivoting plate to rotate at least 10 degrees from a center position relative to the base plate. The flexible member can be made with any suitable material that is sufficiently flexible and elastic. Contemplated materials include a man-made polymer (e.g., urethane, isoprene, resilient plastic), a natural polymer (e.g., rubber), or any mixture thereof (e.g., silicone rubber).

In some embodiments of the current invention, the truck carrying member has a base plate and a pivoting plate, each having a mounting surface and a pivoting surface that form an obtuse angle. Preferably and advantageously, the obtuse angle in the pivoting plate is smaller than the obtuse angle in the base plate, so that the mounting surface of the pivoting plate extends downward from its pivoting surface when the truck carrying member is attached to a bottom surface of the skateboard. The downward mounting surface of the pivoting plate increases a truck's turn angle and decreases the truck's lean angle compared to when the truck is used without the truck carrying adapter, and makes the skateboard more agile by allowing the skateboard to turn more easily and rapidly. Contemplated downward angles are between 0 and 85 degrees, inclusive. In preferred embodiments, the downward angle is between 5 and 45 degrees, inclusive.

In other embodiments of the current invention, the truck carrying member comprises a pivoting plate with a mounting surface for attaching a truck and at least two fasteners for attaching the pivoting plate to a skateboard or a base plate. The fasteners comprise flexible members that allow the pivoting plate to tilt. The flexible members can of any shape, but preferably the shape of a cylindrical bushing. In preferred embodiments, the flexible members have sufficient flexibility to allow the pivoting plate to tilt at least 10 degrees and as much as 80 degrees, around a longitudinal axis of the skateboard. The flexible members can also absorb shock (e.g., due to sudden landing) and dampen vibration from the ground (e.g., due to uneven surface) and thus provides a more smooth and comfortable riding experience.

From a methods perspective, the inventive subject matter comprises the steps of: (i) removing a conventional truck from a skateboard deck, (ii) attaching the conventional truck to a pivoting plate of a truck carrying member (e.g., front or rear adapter), and (iii) coupling the truck carrying member to the skateboard. It is further contemplated that in some embodiments steps (ii) and (iii) could be reversed.

Various objects, features, aspects and advantages of the inventive subject matter will become more apparent from the following detailed description of preferred embodiments, along with the accompanying drawing figures in which like numerals represent like components. The drawing figures are embodiments (i.e., examples) described from the observer's perspective and may not be drawn to scale.

DETAILED DESCRIPTION

Figure 1:
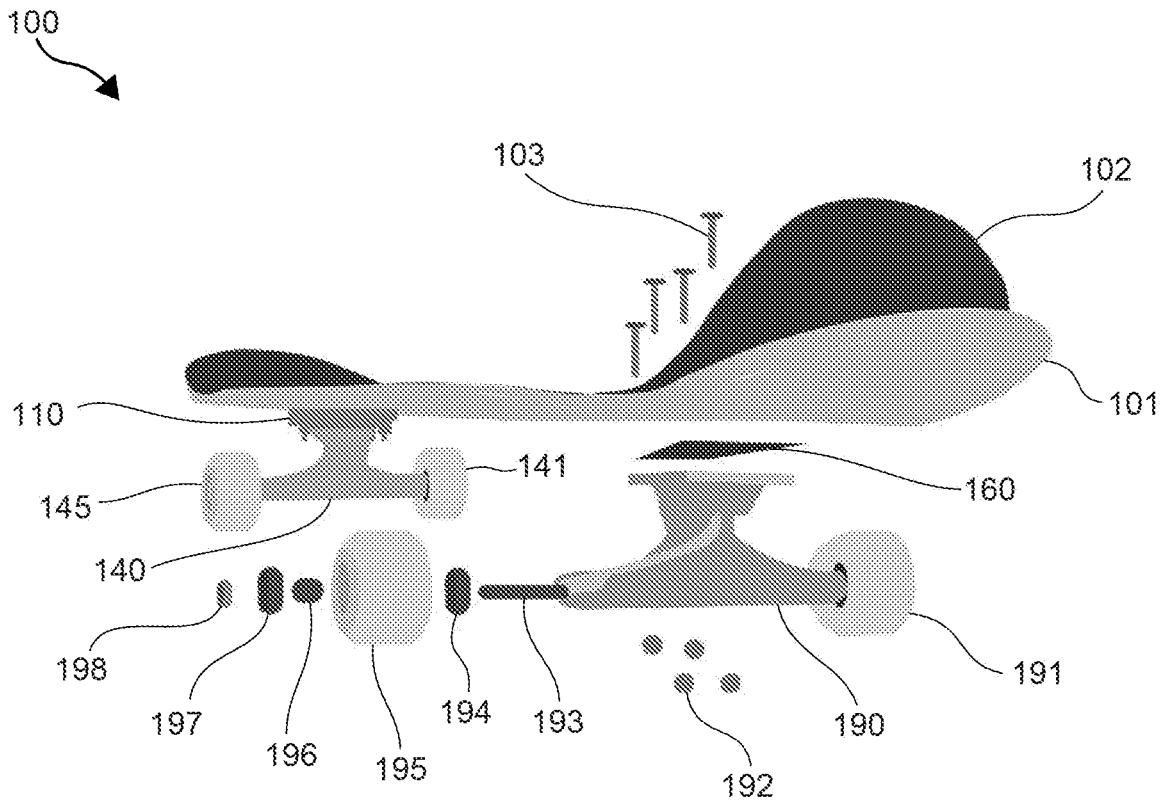
FIG. 1 is a front perspective view of a conventional skateboard and a partially exploded view of the front truck and wheel.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Unless the context dictates the contrary, all ranges set forth herein should be interpreted as being inclusive of their endpoints, and open-ended ranges should be interpreted to include only commercially practical values. Similarly, all lists of values should be considered as inclusive of intermediate values unless the context indicates the contrary.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g., "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

The following discussion provides example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

FIG. 1 is a perspective view of a conventional skateboard 100. The skateboard 100 has a deck 101, a grip surface 102, a front truck carrying member 110, a front truck 140, a vibration absorbing pad 160, and a rear truck 190. Each truck (140 and 190) has an axle (front truck axle not shown, rear truck axle 193) and two wheels (141,145, 191, and 195). Fastening mechanisms including bolts 103 and screws, adhesive, etc., are necessary for the assembly of the skateboard. Although not shown in FIG. 1, it is commonly known that the bolts 103 are arranged in a standard pattern across most skateboard products. Some embodiments of the current inventive subject matter conform to this standard pattern, so that the adaptors in the current inventive subject matter can be easily mounted to existing skateboards or skateboards made by other manufacturers. The grip surface 102 is covered by grip tapes that help a rider's feet stick to the board, especially during turning. The current inventive subject matter allows the board to tilt at a larger angle during turning than a board with a conventional truck, so a rider can rely less on the frictional force provided by the grip tape, and more on the support from the deck as the centripetal force required for turning.

Figure 2:
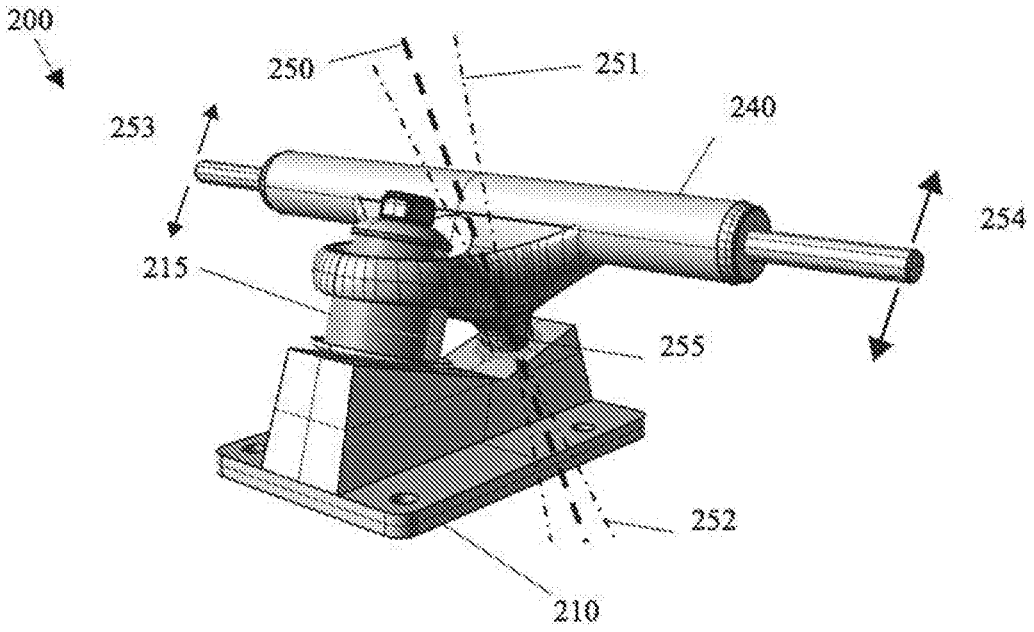
FIG. 2 is a perspective view of a conventional truck.

FIG. 2 is a perspective view of a conventional skateboard truck 200. A conventional truck 200 has a pivot axis 250 and a bushing 215 that allows the wheel axle 240 to turn and to tilt (253 and 254). The tiling and turning motion (253 and 254) are very limited in magnitude and scope, and can be slightly non-planar due to wobble (251 and 252) at the pivot 255. The tiling and turning motion (253 and 254) also allows a conventional truck to turn. Specifically, when a rider stands on the skateboard with his feet perpendicular to the longitudinal axis of the skateboard, the rider can turn the skateboard by shifting his weight from toe to heal, or vice versa. When the rider pushes on his toes, the toe side of the deck dips towards the ground while the heal side of the deck lifts. For example, during a left turn, the wheels on the left side of the skateboard [are tucked in closer to the deck than the wheels on the right side. In addition, during a left turn the wheels on the left move closer together and the wheels on the right move apart.

Figure 3:
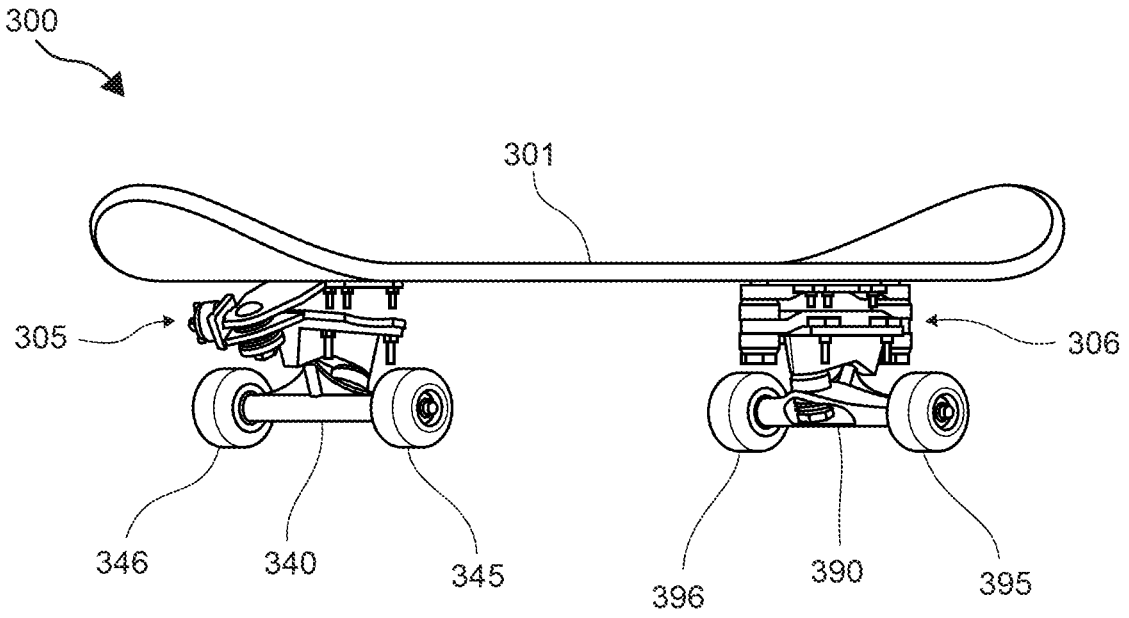
FIG. 3 is a perspective view of an embodiment of a skateboard having a front truck carrying member and a rear truck carrying member.
Figure 4:
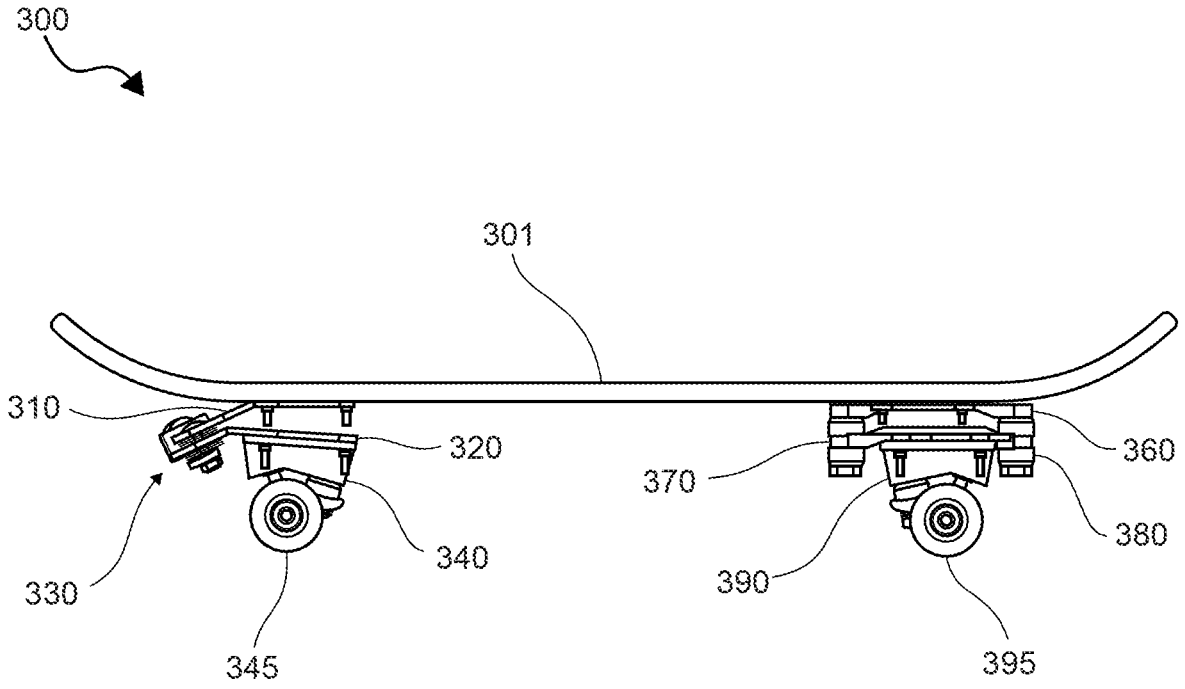
FIG. 4 is a side view of the skateboard of FIG. 3.

FIG. 3 is a perspective view of an embedment of a skateboard 300 having a deck 301, a front truck carrying member 305, a rear truck carrying member 306, a front truck 340, and a rear truck 390. FIG. 4 is a side view of the skateboard 300 of FIG. 3. The front truck carrying member 305 has a base plate 310, a pivoting plate 320, and a biasing member 330. The rear truck carrying member 306 has a base plate 360, a pivoting plate 370, and bushings (e.g., 380).

Overall, a truck carrying member (305 and 306) can provide a conventional skateboard with advantageous technical effects, including increased maneuverability, without any modification to a conventional skateboard deck 101 or conventional truck 200. The advantages include easier and shaper turns, shortened turning radius, smoother transition between turns, and increased tilting potential of deck 301. These technical improvements enable the rider to make shaper turns and experience an enhanced riding sensation. Moreover, a truck carrying member (305 and 306) allows the rider to generate speed without pumping (i.e., pushing off of the ground with one's foot), for example, by performing an "S" turn.

As used herein, a truck carrying member (305 or 306) is an adaptor that connects a skateboard deck 301 to a truck (340 or 390). When used on the front end of a skateboard 301, a truck carrying member (305) is also referred to as a "front adapter." When used on the back end of a skateboard 301, a truck carrying member 306 is also referred to as a "rear adapter." However, it is contemplated the truck carrying members (305 or 306) can be used either on the front truck 340 or on the back truck 390 of a skateboard. For example, a rear adaptor 306 can be installed on the front end of a skateboard, and a front adapter 305 can be used on the back end of a skateboard. It is further contemplated that rear adaptors 306 and front adapters 305 can be used in any combination on a skateboard. For example, a skateboard can have a rear adaptor 306 mounted to both front and rear trucks (340 and 390) simultaneously, which best serves skateboarding during high speed, sliding, and hard cornering.

The truck carrying members (305 or 306) can be of any suitable construction and made of any suitable material, including man-made material (e.g., metal, composite, or plastic), a natural material (e.g., wood or mineral), or any combination thereof. In preferred embodiments, the truck carrying members are made of aluminum.

As used herein, a base plate (310 and 360) is a component of a truck carrying member (305 or 306) that is connected to the skateboard deck 301. A pivoting plate (320 and 370) is a component of a truck carrying member (310 and 360) that rotates or tilts with respect to a skateboard deck 301. In some embodiments, a pivoting plate 320 is coupled to a base plate 310 and can rotate with respect to the base plate 310. In other embodiments, a pivoting plate 370 can tilt along the longitudinal axis of the skateboard deck 301.

The base plate (310 or 360) can be attached to a skateboard 101 and the pivoting plate (320 or 370) can be attached to a truck (340 or 390) in any suitable manner, including using fasteners. Contemplated fasteners include any material or device that can fix a truck carrying member to a deck or a truck, including chemicals (e.g., adhesives, glues, etc.), mechanical connectors (e.g., bolts and screws, male-female connections, quick-release fasteners, etc.), magnets, or any combination thereof.

The front truck carrying member 305 can increase a conventional skateboard's maneuverability by decreasing the turning circle (i.e., turning radius) of the skateboard, which makes the skateboard more agile. A conventional skateboard 100 has a front truck 140 and a rear truck 190 that follow the same arc during turning. However, the rotation of the pivoting plate 320 allows the front truck 340 (which would otherwise remain stationary with respect to the skateboard deck 301) to sway side-to-side. As a result, the pivoting plate 320 allows the front wheels (345 and 346) to turn in a wider arc than the rear wheels (395 and 396). Moreover, the rotation of the pivoting plate 320 allows the skateboard deck 301 to tilt more than a skateboard on conventional trucks (e.g., 200). The tiling angle of the deck 301 is critical to hold the rider's feet to the skateboard as they travel through the arc of a turn. As the deck 301 tilts more, it makes it easier for the rider to make a tighter turn because it can advantageously provide more centripetal force.

Figure 5:
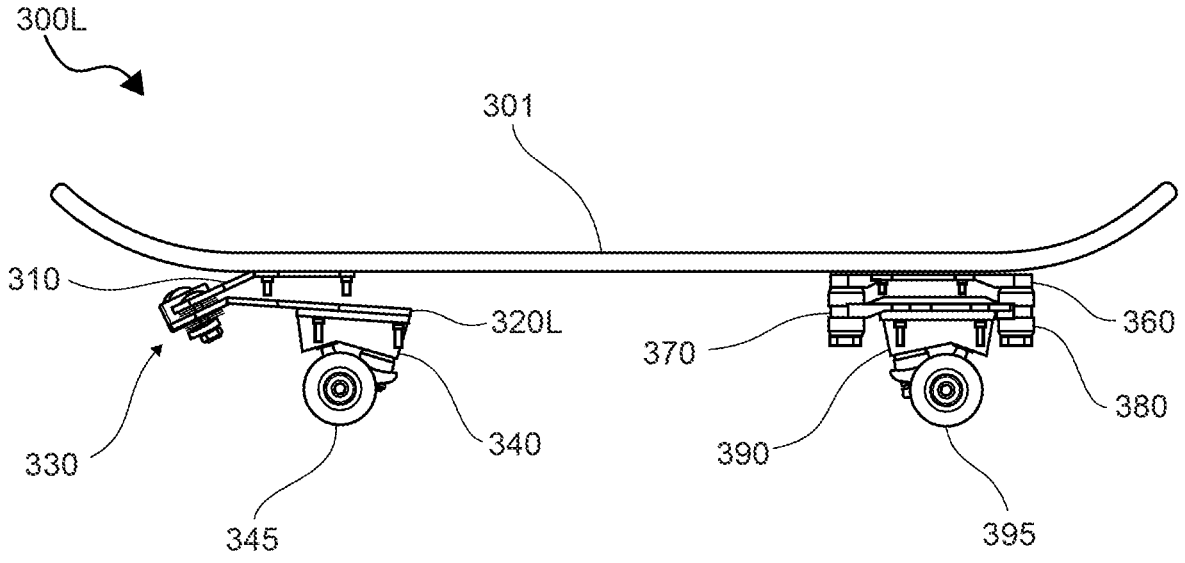
FIG. 5 is a side view of the skateboard of FIG. 3, with an elongated pivoting plate in the front truck carrying member.

It is also contemplated that the pivoting plates (320 and 370) can be used to elongate or shorten the wheelbase (i.e., the distance between the front and rear axles of a skateboard). The wheelbase of a board can also change the turning circle of a skateboard. A longer wheelbase increases the turning circle, and a shorter wheelbase decreases the turning circle and makes the board more agile. It is further contemplated a truck (340 or 390) can be repositioned in front of or behind the conventional location of the truck. For example, in FIG. 5, the pivoting plate 320L of the front adaptor 305 is longer than the pivoting plate 320 in FIG. 4. As a result, the front truck 340 is located closer to the rear truck 390, so the wheelbase is decreased.

Figure 6A:
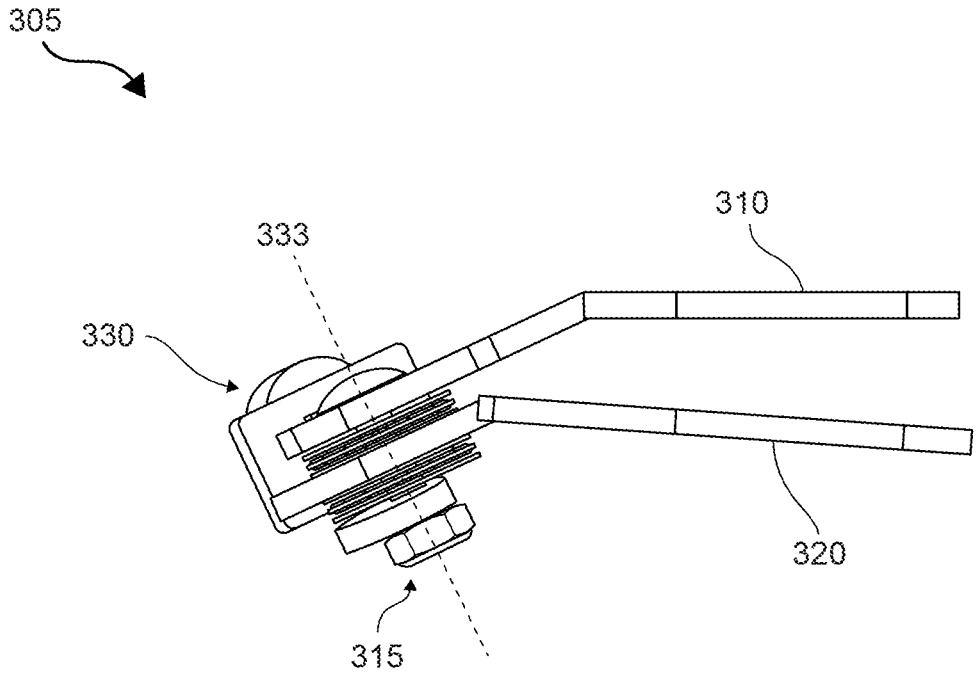
FIG. 6*a* is a side view of the front truck carrying member of FIG. 3.
Figure 6B:
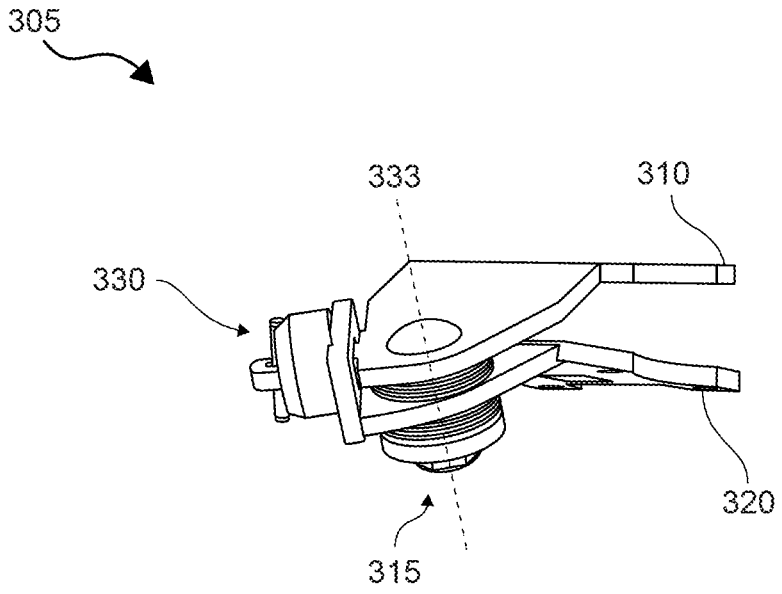
FIG. 6*b* is a front perspective view of the front truck carrying member of FIG. 3.

FIG. 6*a* is a side view of the front truck carrying member 305 of FIG. 3. FIG. 6*b* is a front perspective view of the front truck carrying member 305 of FIG. 3. A preferred embodiment of the front truck carrying member 305 comprises a base plate 310 and a pivoting plate 320 that are rotatably coupled at a pivot 315. The front truck carrying member 305 also has a biasing member 330 that resists movement of the pivoting plate 320 and biases the pivoting plate 320 in a default, and preferably, centered position relative to the base plate 310.

Figure 7:
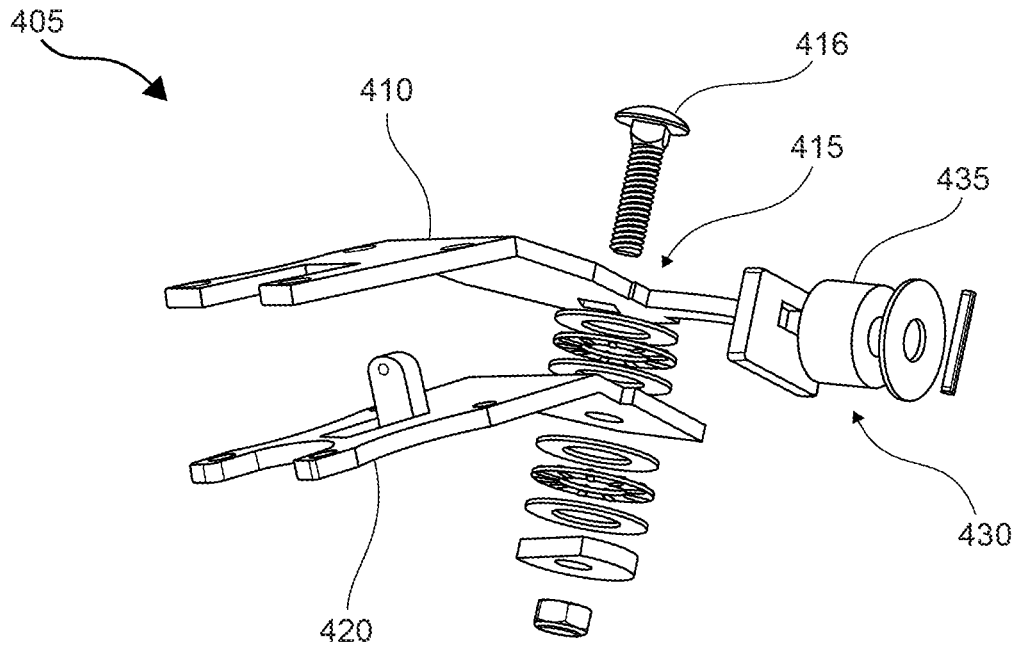
FIG. 7 is an exploded view of another embodiment of a truck carrying member.
Figure 8:
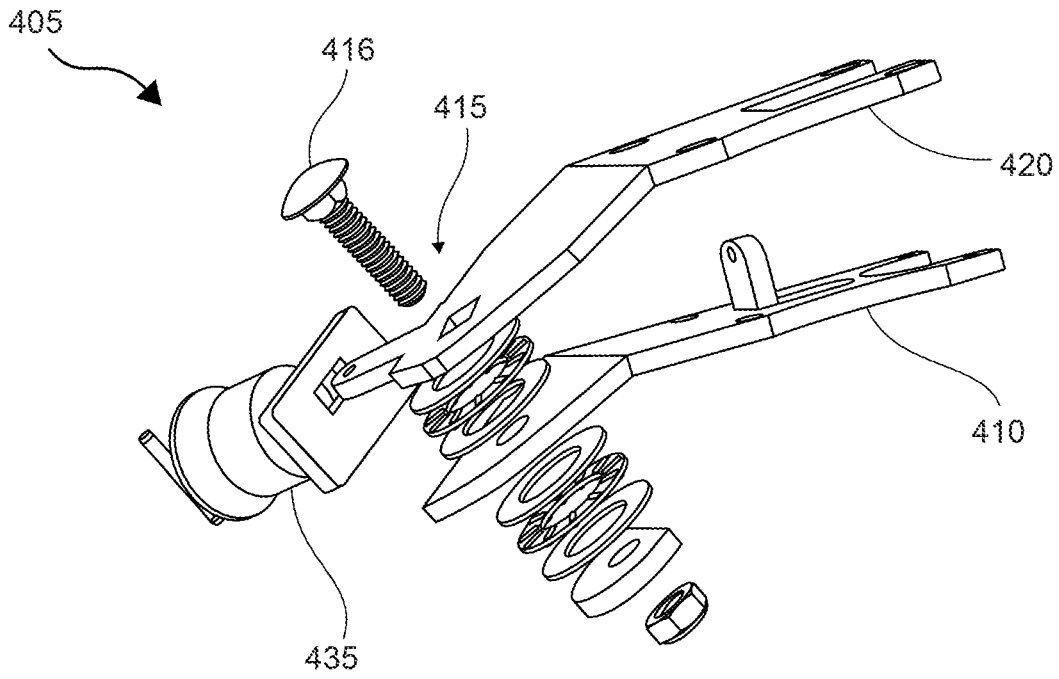
FIG. 8 is an exploded view of the truck carrying member of FIG. 7 viewed from another perspective.
Figure 9:
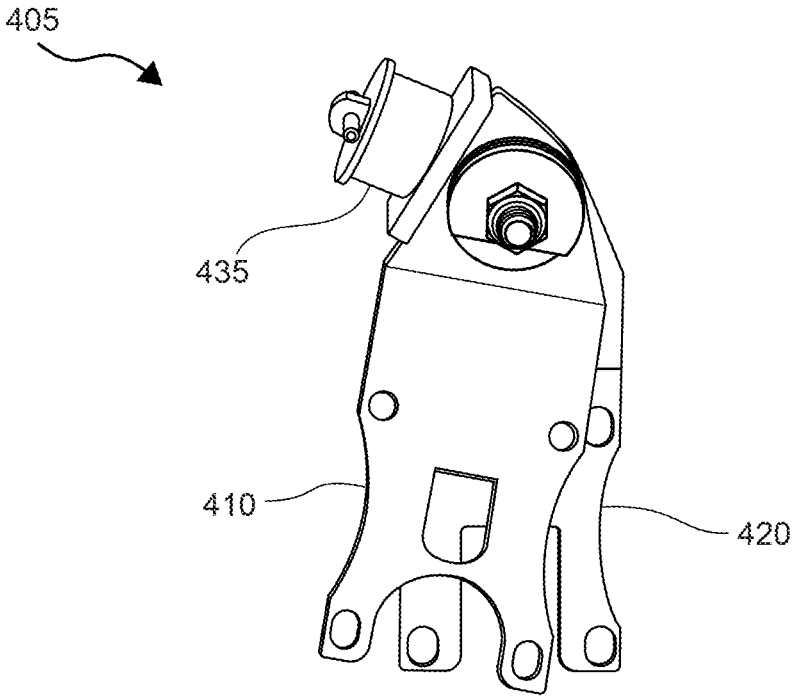
FIG. 9 is a bottom view of the truck carrying member of FIG. 7.
Figure 10:
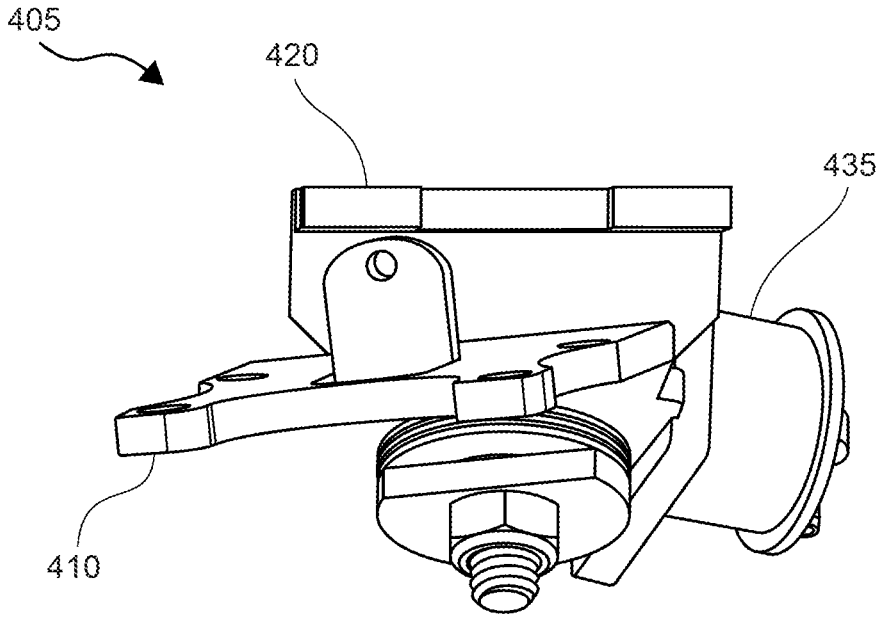
FIG. 10 is a bottom rear perspective view of the truck carrying member of FIG. 7.

FIG. 7 is an exploded view of another embodiment of a truck carrying member 405 comprising a base plate 410, a pivoting plate 420, a pivot coupling mechanism 440, and a biasing member 430 comprising a bushing 435. FIG. 8 is an exploded view of the front truck carrying member 405 of FIG. 7 viewed from another perspective. FIG. 9 is a bottom view of the front truck carrying member 405 of FIG. 7. FIG. 10 is a bottom rear view of the front truck carrying member 405 of FIG. 7. In this embodiment, the pivot coupling mechanism 415 comprises a bolt 416 that couples the base plate 410 to the pivoting plate 420.

The performance of a skateboard equipped with a front adaptor 305 would be limited if the rear truck 390 is equipped with a conventional truck carrying member 200 having limited pivoting capabilities. The rear adapter 306 enhances the performance of a skateboard as a whole by allowing the rear end of the skateboard to tilt. In preferred embodiments, the rear adaptor 306 allows the back end of the skateboard to tilt at least 10 degrees. In especially preferred embodiments, the rear adaptor 306 allows the back end of the skateboard to tilt at least 45 degrees.

Figure 11:
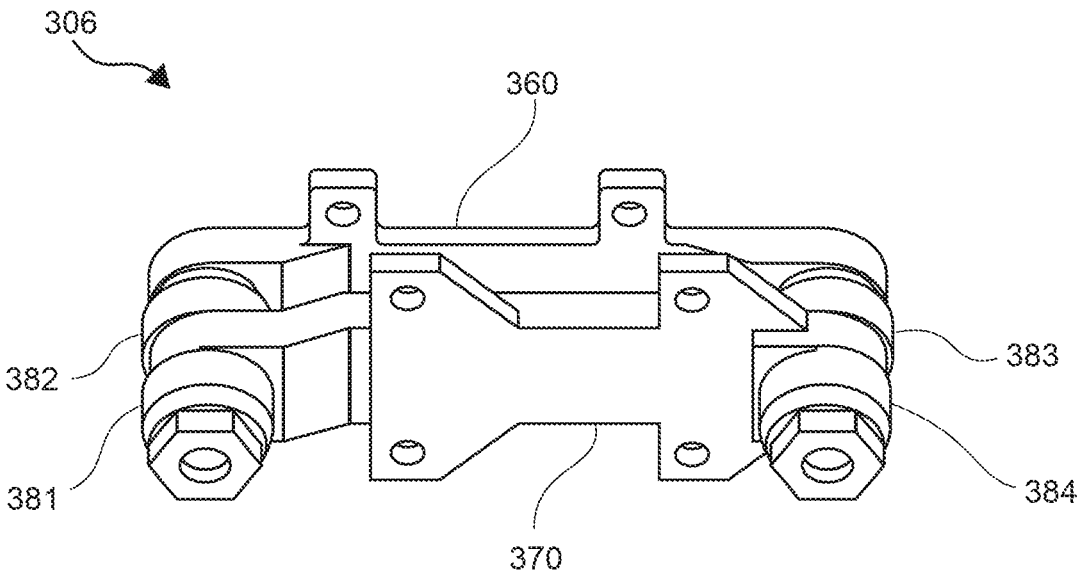
FIG. 11 is a bottom view of the rear truck carrying member of FIG. 3.
Figure 12:
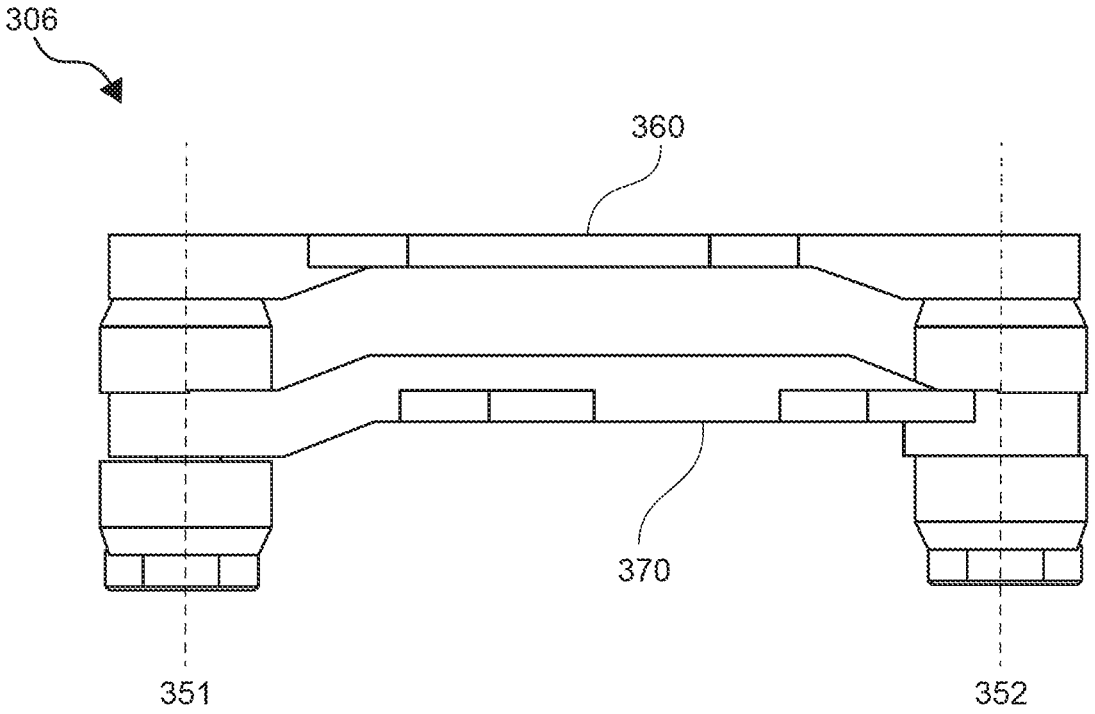
FIG. 12 is a side view of the rear truck carrying member of FIG. 3.
Figure 13:
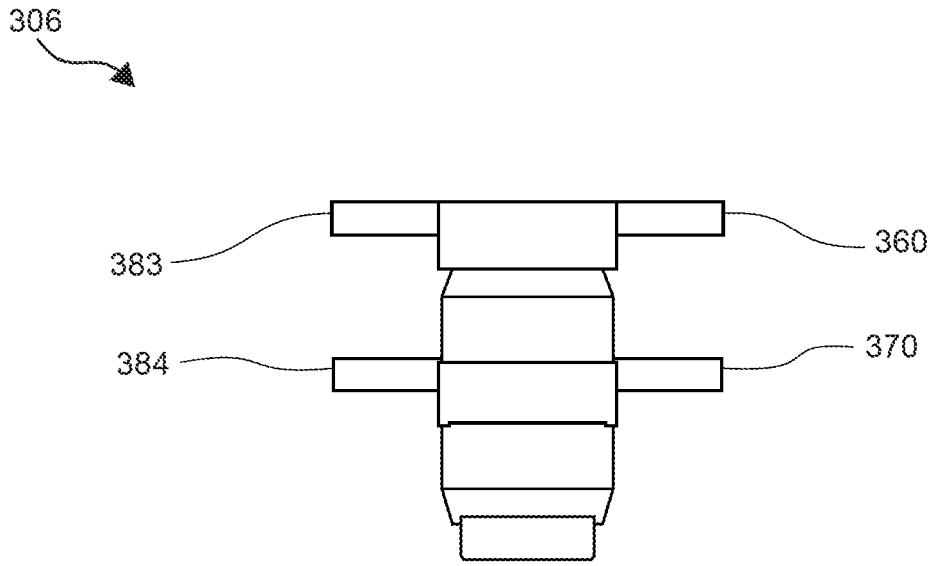
FIG. 13 is a rear view of the rear truck carrying member of FIG. 3.
Figure 14:
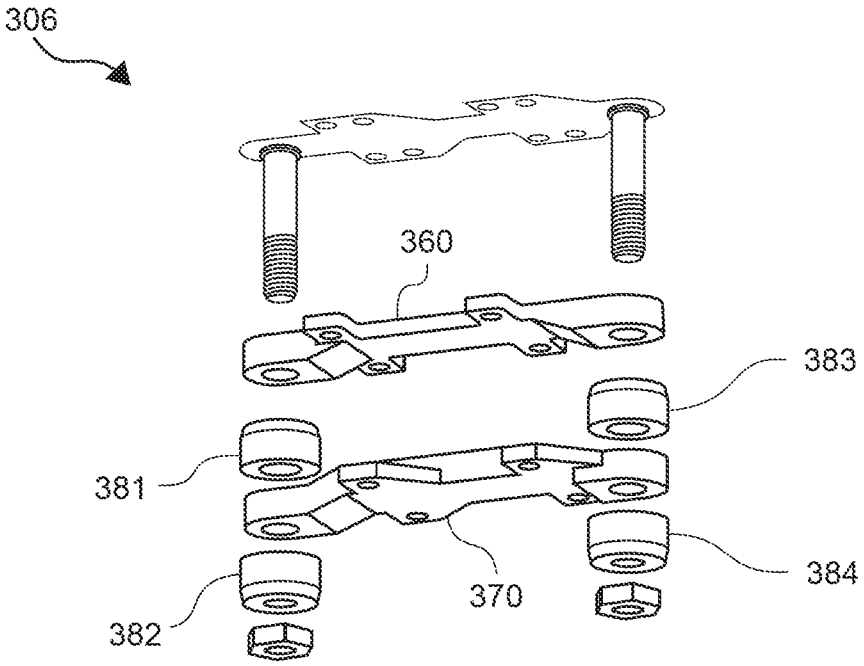
FIG. 14 is an exploded view of the rear truck carrying member of FIG. 3.
Figure 15A:
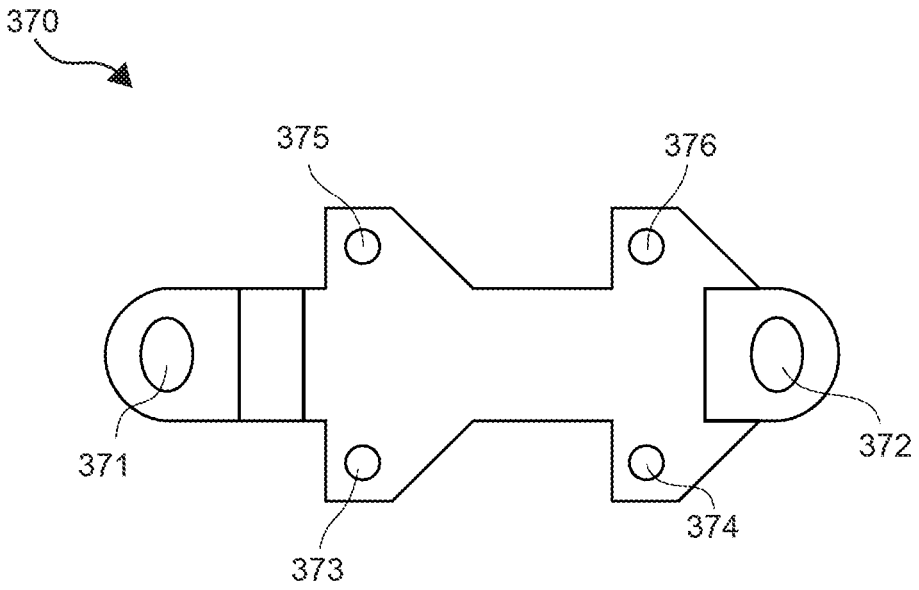
FIG. 15*a* is a bottom view of the pivoting plate of the rear truck carrying member of FIG. 3.
Figure 16:
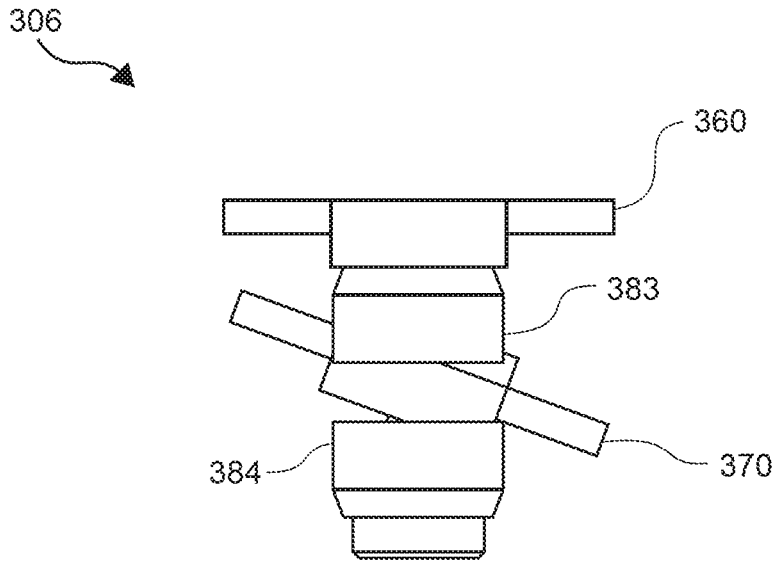
FIG. 16 is a rear view of the rear truck carrying member of FIG. 3, shown in a turning configuration.
Figure 17:
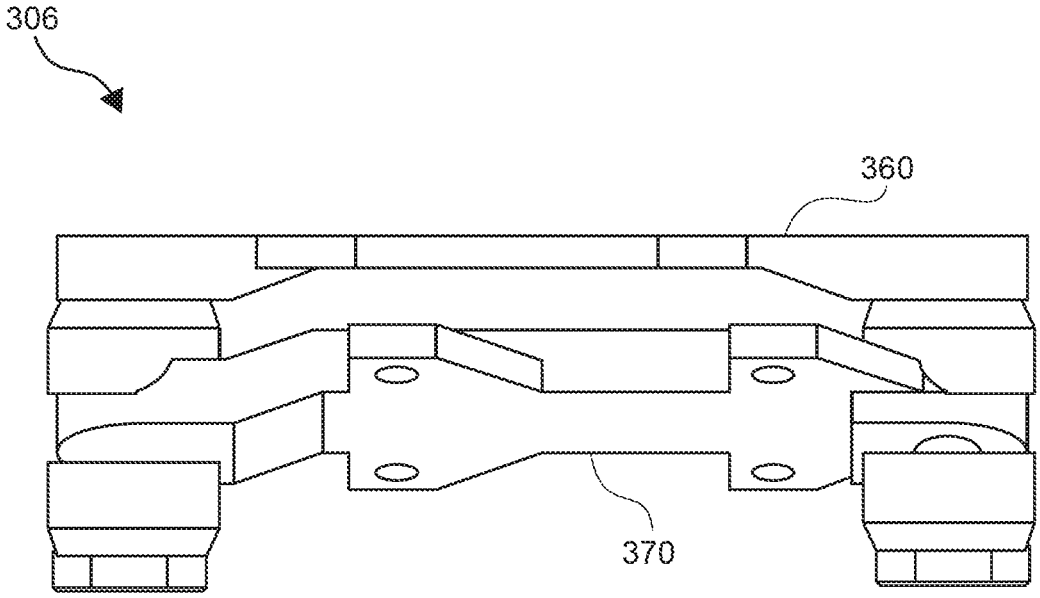
FIG. 17 is a side view of the rear truck carrying member of FIG. 3, shown in a turning configuration.

FIG. 11 is a bottom view of the rear truck carrying member 306 of FIG. 3. FIG. 12 is a side view of the rear truck carrying member 306 of FIG. 3. FIG. 13 is a rear view of the rear truck carrying member 306 of FIG. 3. FIG. 14 is an exploded view of the rear truck carrying member 306 of FIG. 3. The rear truck carrying member 306 comprises a base plate 360 and a pivoting plate 370 that are coupled together via two axes of rotation (351 and 352). It is contemplated that flexible members (381-384) can be placed above, below, or between the base plate 360 and the pivoting plate 370. In preferred embodiments, flexible members 381-383 are placed between the base plate 360 and the pivoting plate 370, and below the pivoting plate 370. The elasticity of the flexible members (381-384) and the elongated holes (371 and 372) on the pivoting plate 370 (see FIG. 15*a*) allow the pivoting plate 370 to tilt (rock and roll) with respect to the base plate 360 (see FIG. 16). Moreover, the flexible members (381-384) can absorb shock (e.g., due to sudden landing) and dampen the vibration from the ground (e.g., due to uneven surface) and thus provides a more smooth and comfortable riding experience.

Figure 15B:
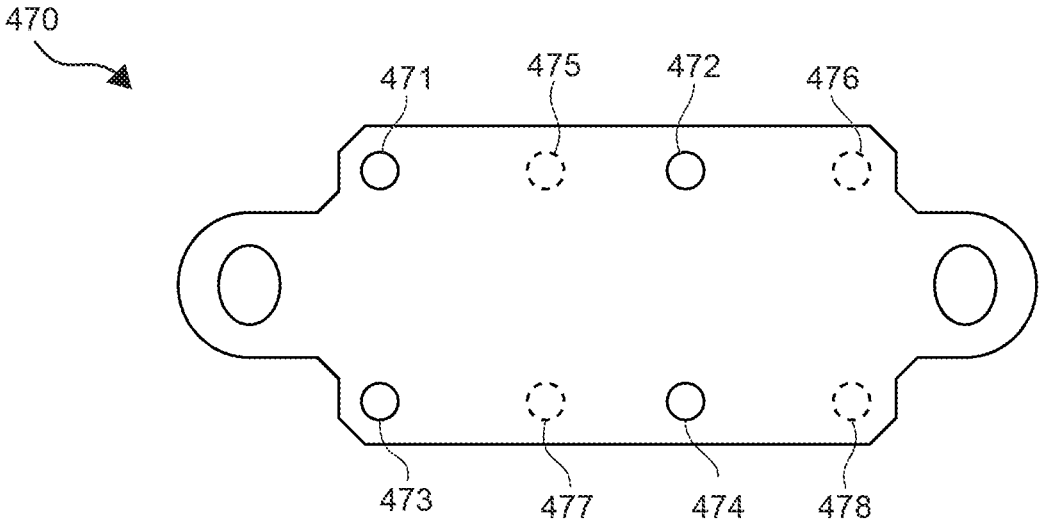
FIG. 15*b* is top view of a modified embodiment of a pivoting plate in the rear truck carrying member.

The base plate 360 of the rear truck carrying member 306 can be coupled with the skateboard 301 using fasteners, preferably holes and screws. The pivoting plate 370 can be coupled with a conventional truck 390 using similar fasteners. It is contemplated that the holes (373-376) on the pivoting plate 370, can be repositioned to adjust the location of the rear truck 390 relative to its conventional position (at or near the holes on the skateboard deck 301). For example, the pivoting plate 470 in FIG. 15*b* has one set of four apertures (471-474) for attaching to a truck 390. The pivoting plate 470 can be modified to have another set of four apertures (475-478) for attaching to a truck 390. Since the apertures (475-478) allow the truck 390 to be positioned more to the rear end of the skateboard deck 301 than apertures (471-474), the truck 390 can be located further away from the front truck 340 and the wheelbase can be increased.

The rear truck carrying member 306 allows deck 301 to tilt along the longitudinal axis of the board more than a deck mounted to a traditional truck would tilt without the rear truck carrying member 306. In preferred embodiments, the pivoting plate 370 can tilt at least 10 degrees, inclusive, on either side. In especially preferred embodiments, the pivoting plate 370 can tilt at least 45 degrees, inclusive, on either side.

Figure 18:
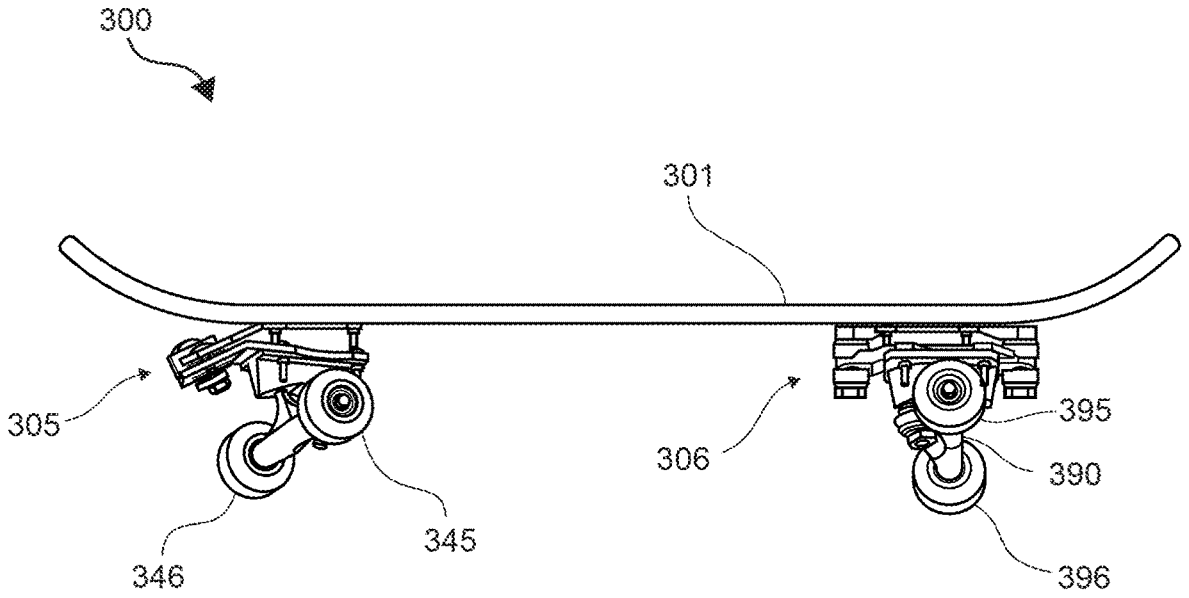
FIG. 18 is a bottom perspective view of the skateboard of FIG. 3 having a front truck carrying member and a rear truck carrying member shown in a turning configuration.

FIG. 18 is a perspective view of the skateboard 300 in FIG. 3, shown in a turning configuration (to the left). In this left turn configuration, the left front wheel 345 tucks inward and rearward, and the left rear wheel 395 tucks up closer to the deck 301. If the skateboard were to be turning right, then the front right wheel 346 would tuck inward and rearward. The rear right wheel 396 would tuck up closer to the right side of the deck 301. The front truck carrying member 305 allows the front wheels (345 and 346) to tuck inward and rearward even more than those in a conventional truck 200.

The rear truck carrying member 306 allows the rear wheels (395 and 396) to tuck up closer to the board 301 than those in a normal truck 200. As the front wheels (345 and 346) are tucked in harder, the deck 301 is at a steeper angle, which allows the deck 301 to face the point around which the rider is turning. The steeper angle also serves to hold the rider's feet to the board and to provide more centripetal force required for turning. The feeling of a deck 301 cradling a rider's feet provides a comfortable sensation and allows the rider to corner harder and to carry more speed through a turn, without the outside wheels lifting off of the ground or loosing grip due to centrifugal force.

The front truck carrying member 305 allows more speed to be carried through turns while reducing the turn of the rear wheels (395 and 396). The front adapter 305 allows the front wheels (345 and 346) to point more in the direction of turning thus making the turning circle tighter. The rear truck carrying member 306 allows the deck 301 to tilt while allowing the outside wheel to maintain contact with the ground during hard cornering and provide more grip from the outside wheel.

It is appreciated that a skateboard having both front and rear adapters (305 and 306) allows for the fastest and/or tightest and most controlled turns. The adapters (305 and 306) work together to allow the front of the board to rapidly change directions, and the rear adaptor 306 allows the user to pivot off of the rear wheels (395, 396) to change the direction of the skateboard, while allowing hard sharp cornering where both outside wheels contact the ground to provide grip, unlike a conventional truck where the outside wheels may lift off the ground during a sharp turn. Both front and rear adapters (305 and 306) help distribute force to the wheels on the outside of the turn so that more speed can be carried through the turn, whereas force is more distributed on the inside wheels in conventional trucks (e.g., 200).

Figure 19:
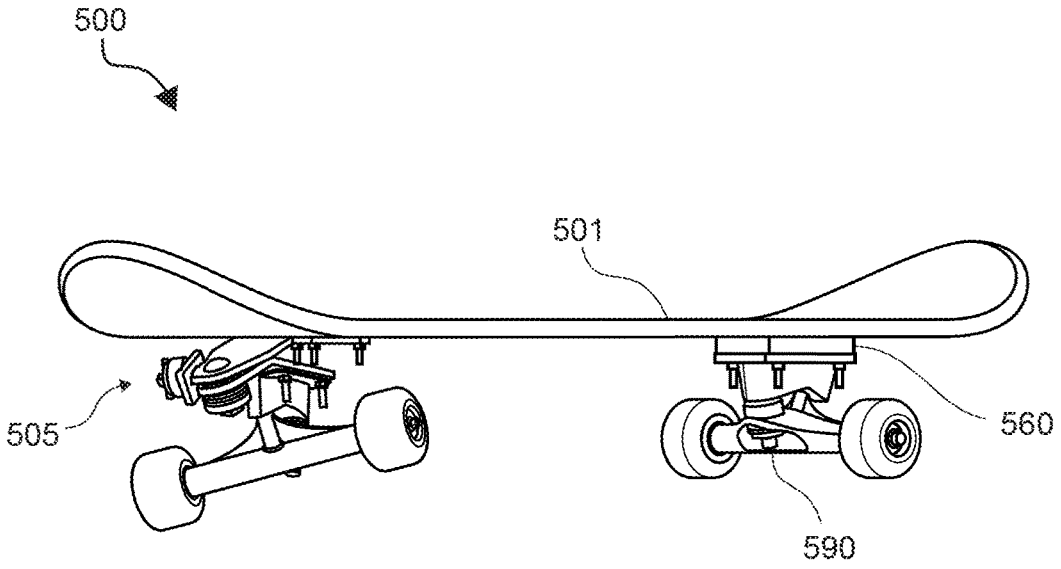
FIG. 19 is a front perspective view of another embodiment of a skateboard having a front truck carrying member, shown in a turning configuration.
Figure 20:
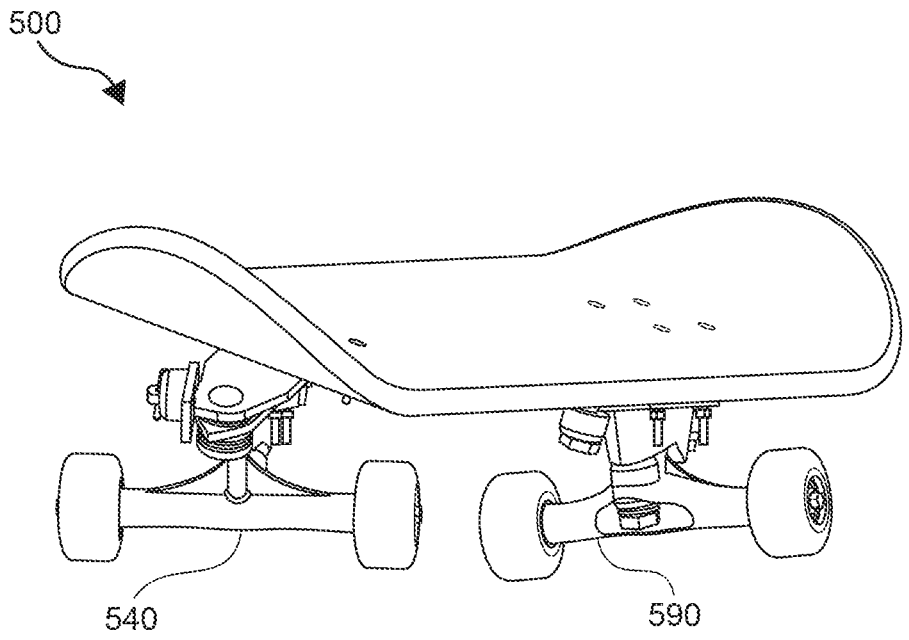
FIG. 20 is a front perspective view of the skateboard of FIG. 18, with the front and rear trucks shown in a turning configuration.
Figure 21:
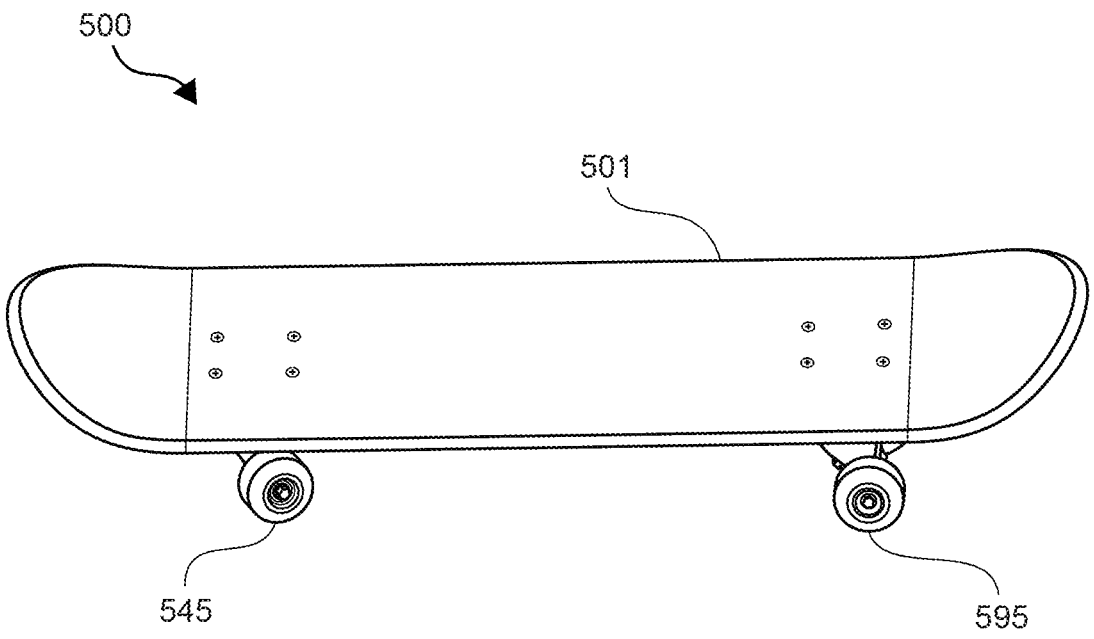
FIG. 21 is a top right perspective of the skateboard of FIG. 18, with the front and rear trucks shown in a turning configuration.

FIG. 19 is a perspective view of a skateboard having a front adaptor 505 on the front without a rear adaptor on the rear. In this embodiment, the rear truck 590 is equipped with a riser 560 (e.g., spacer) between the skateboard deck 501 and the truck 590. FIG. 20 is a perspective of the skateboard of FIG. 19, with the front truck 540 and the rear truck 590 shown in a turning configuration. FIG. 21 is a perspective view of a skateboard in FIG. 20.

Figure 22A:
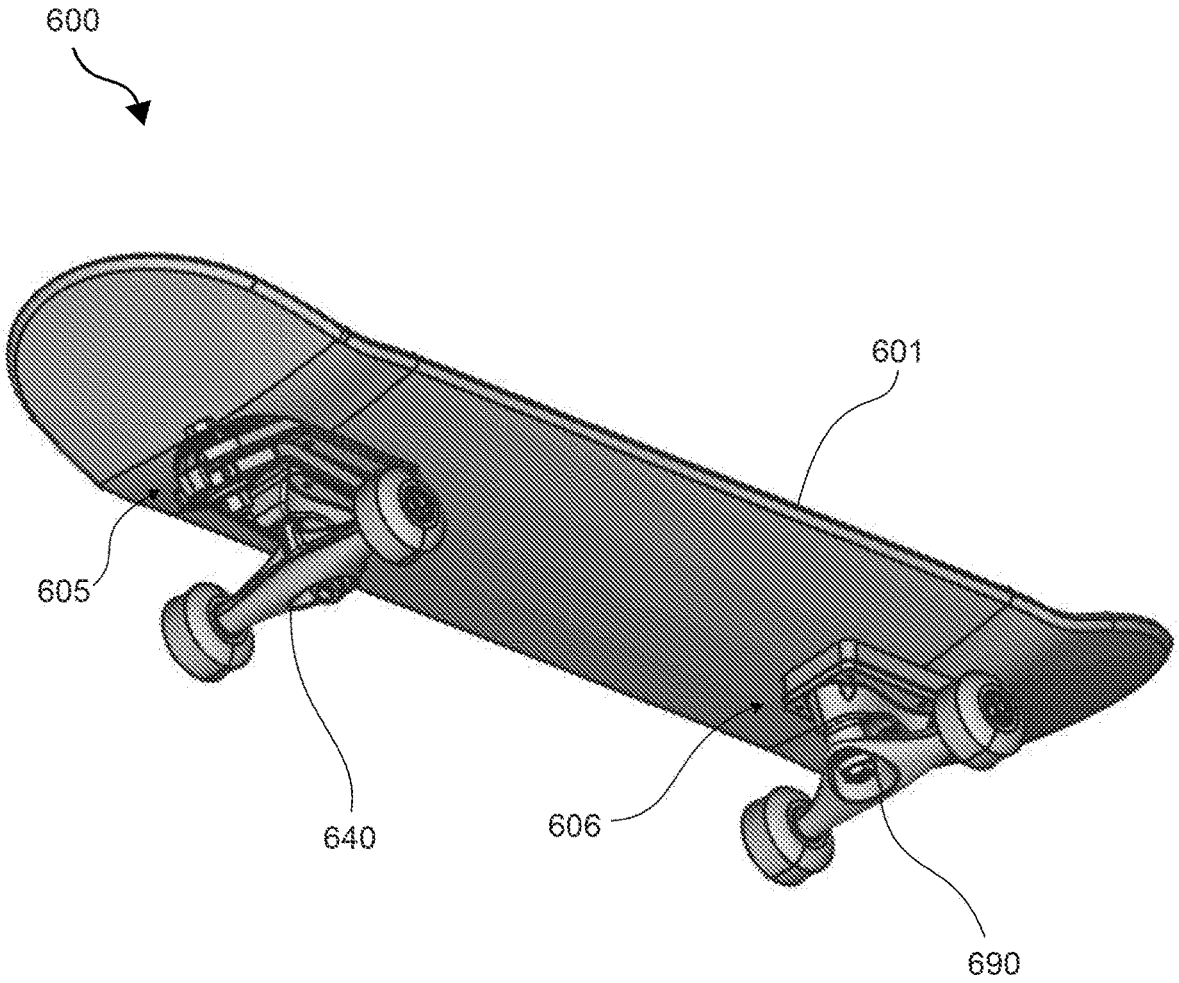
FIG. 22*a* is a front bottom right perspective view of an embodiment of a skateboard fully assembled.
Figure 22B:
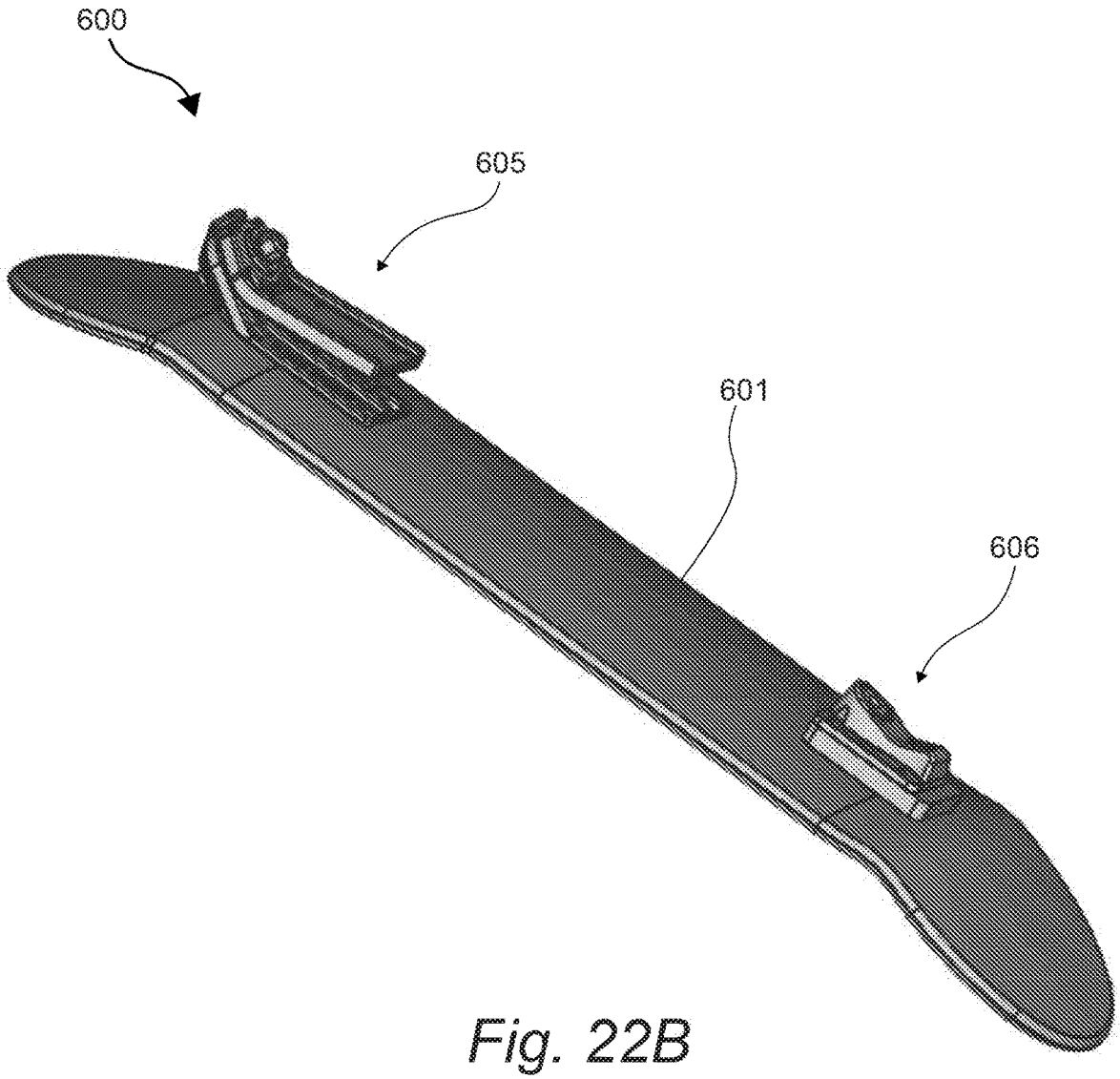
FIG. 22*b* is a bottom left perspective view of the skateboard in FIG. 22*a* with an embodiment of front and back truck carrying members.
Figure 22C:
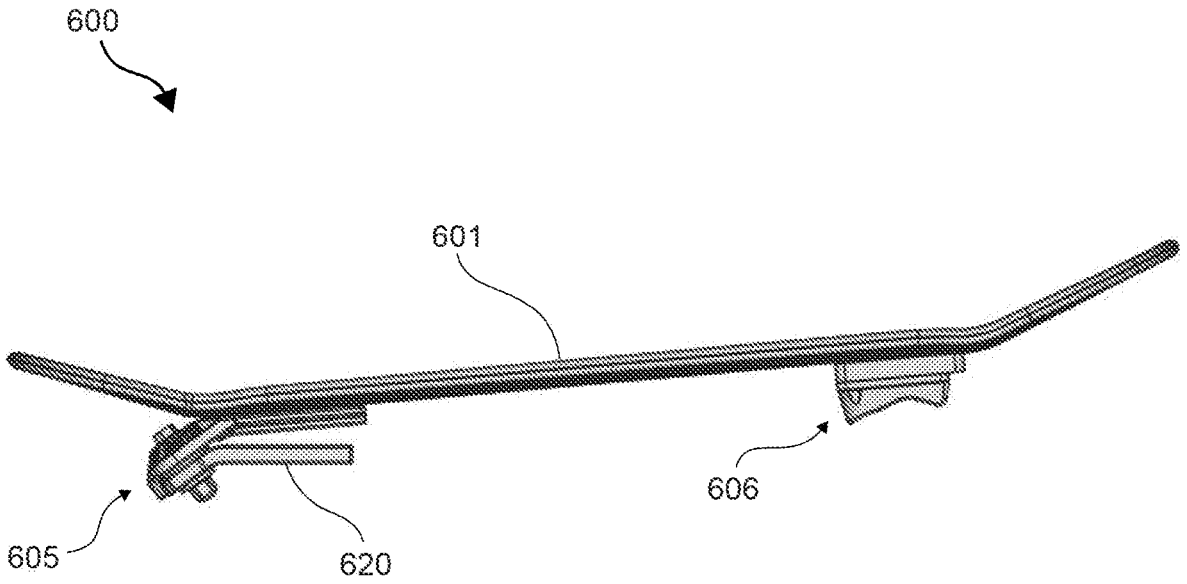
FIG. 22*c* is a right side view of the skateboard in FIG. 22*b*.
Figure 23A:
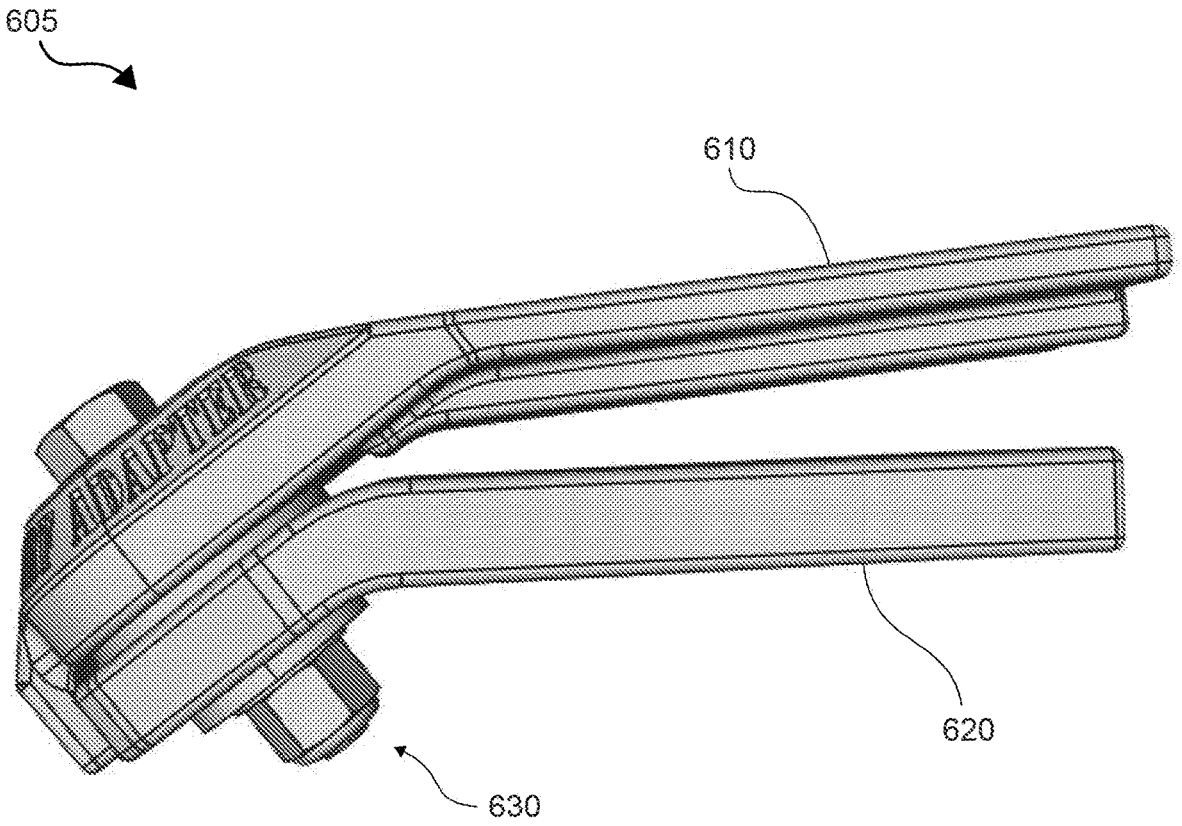
FIG. 23*a* is a right side view of an embodiment the front truck carrying member in FIG. 22*a*.
Figure 23B:
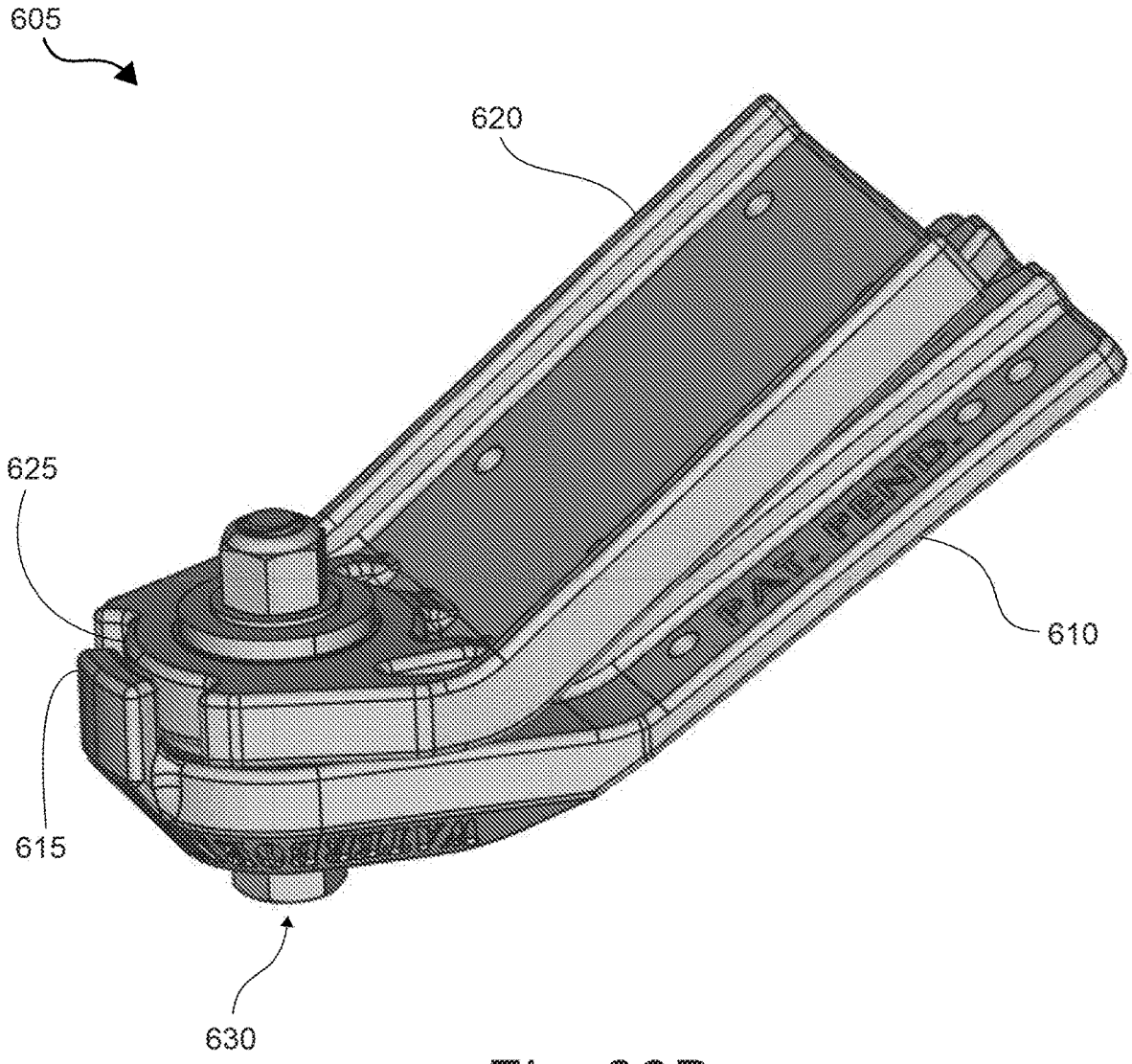
FIG. 23*b* is a bottom left side perspective view of the front truck carrying member in FIG. 23*a*
Figure 23C:
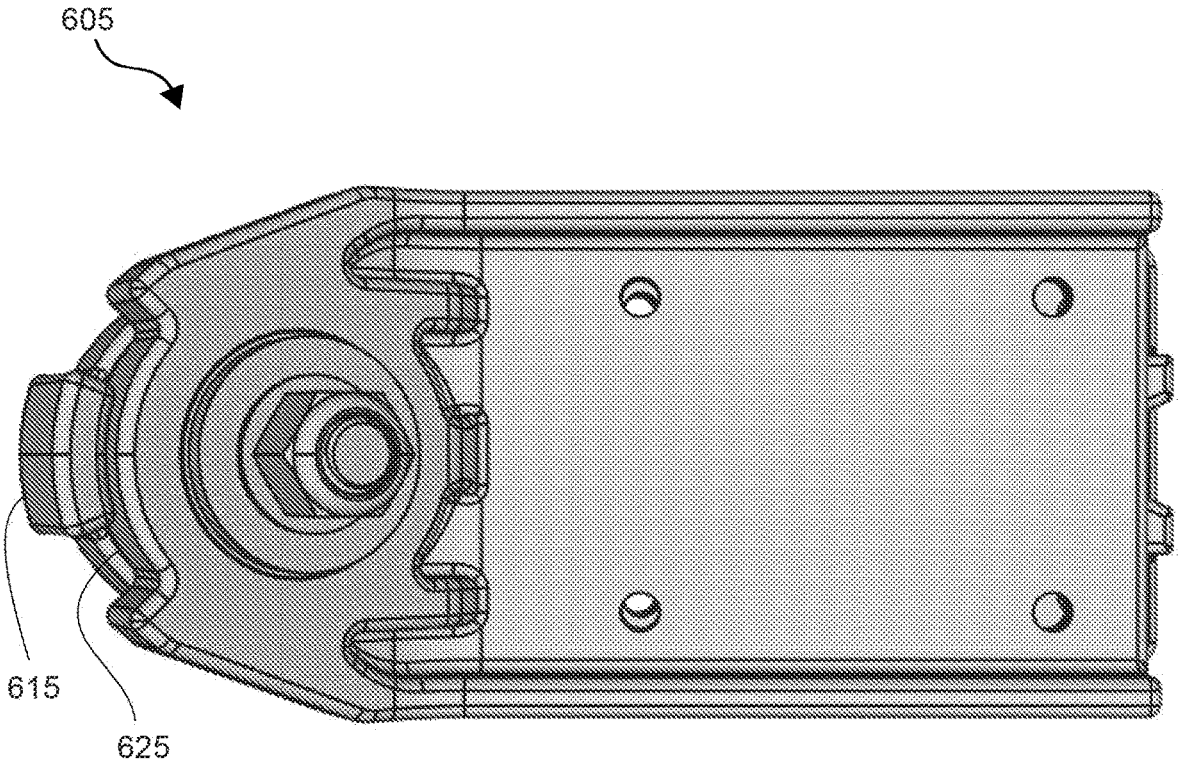
FIG. 23*c* is a bottom view of the front truck carrying member in FIG. 23*a*.
Figure 23D:
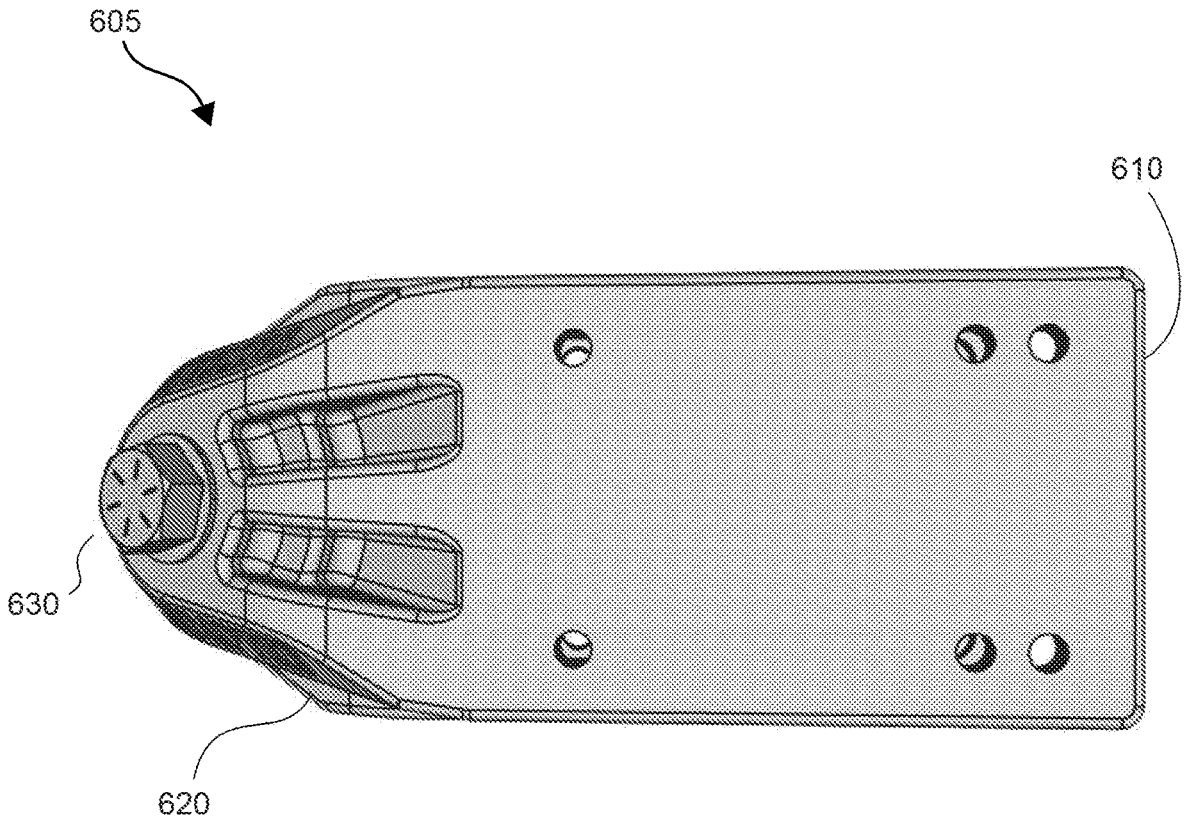
FIG. 23*d* is a top view of the front truck carrying member in FIG. 23*a*.
Figure 23E:
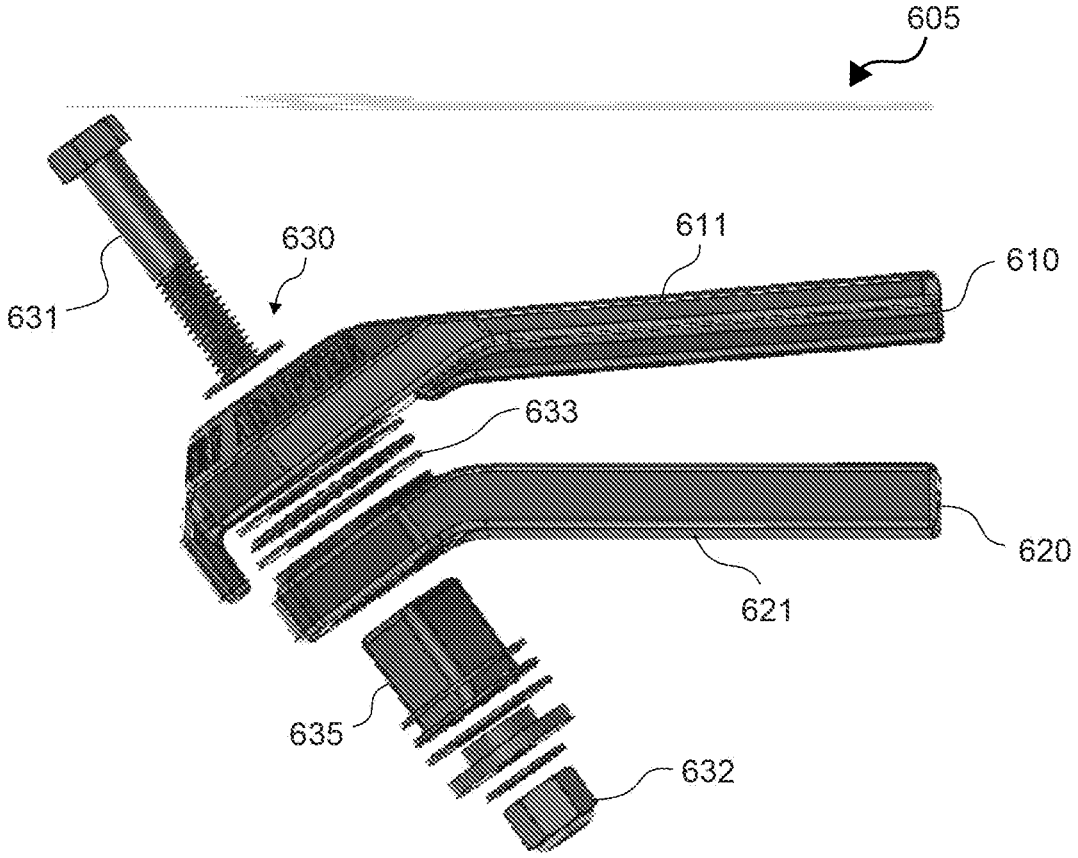
FIG. 23*e* is an exploded right side view of the front truck carrying member in FIG. 23*a*.
Figure 23F:
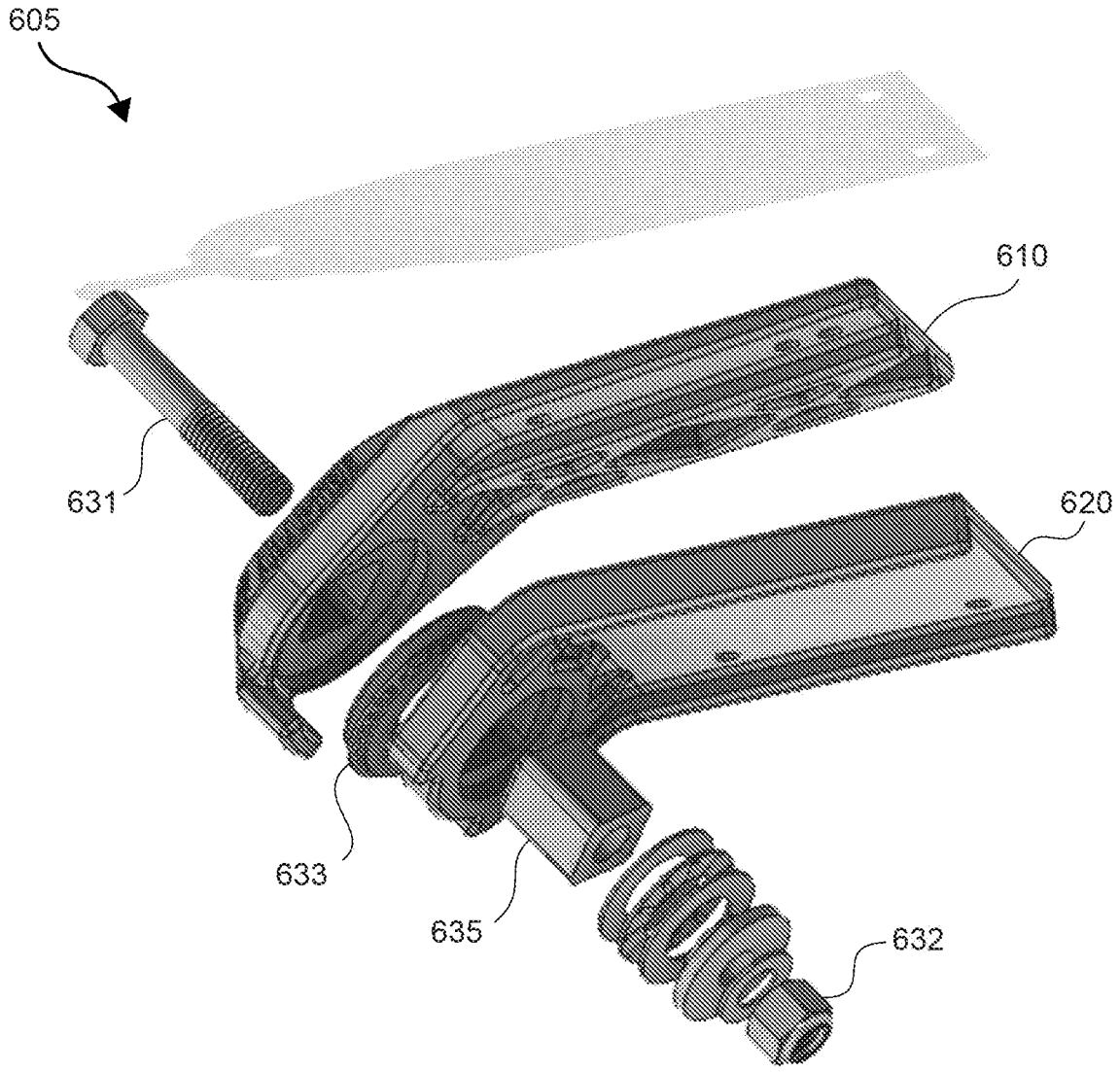
FIG. 23*f* is an exploded right side perspective view of the front truck carrying member in FIG. 23*a*.
Figure 24A:
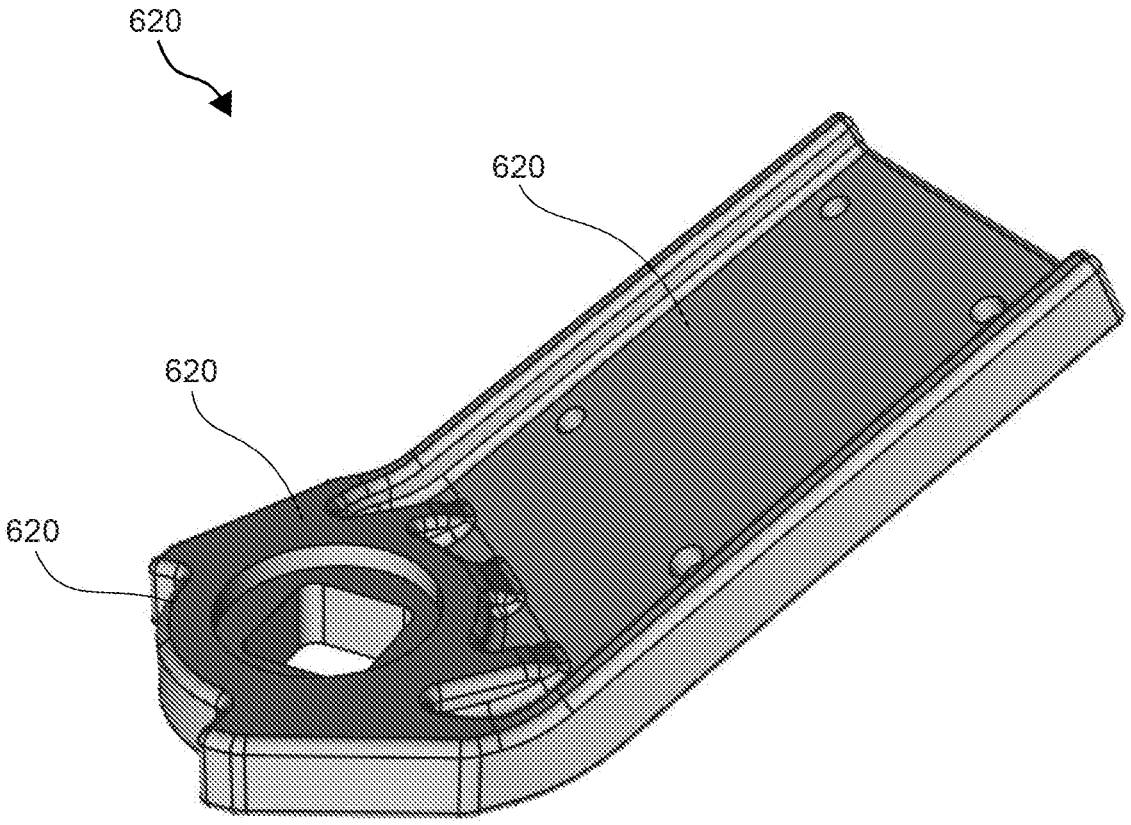
FIG. 24*a* is a perspective bottom left side view of an embodiment of the pivoting plate of the front truck carrying member in FIG. 23*a*.
Figure 24B:
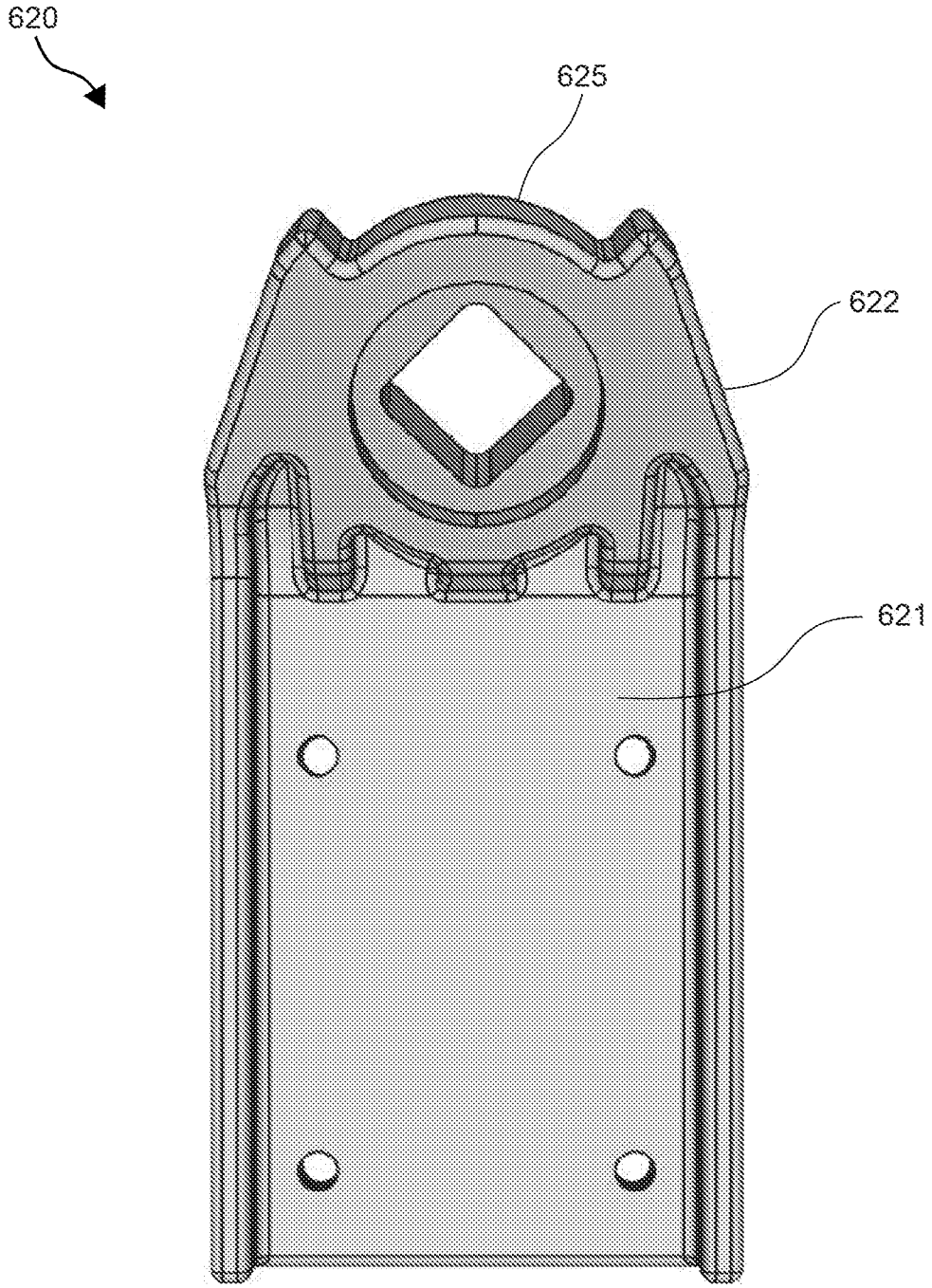
FIG. 24*b* is a bottom view of an embodiment of the pivoting plate of the front truck carrying member in FIG. 24*a*.
Figure 24C:
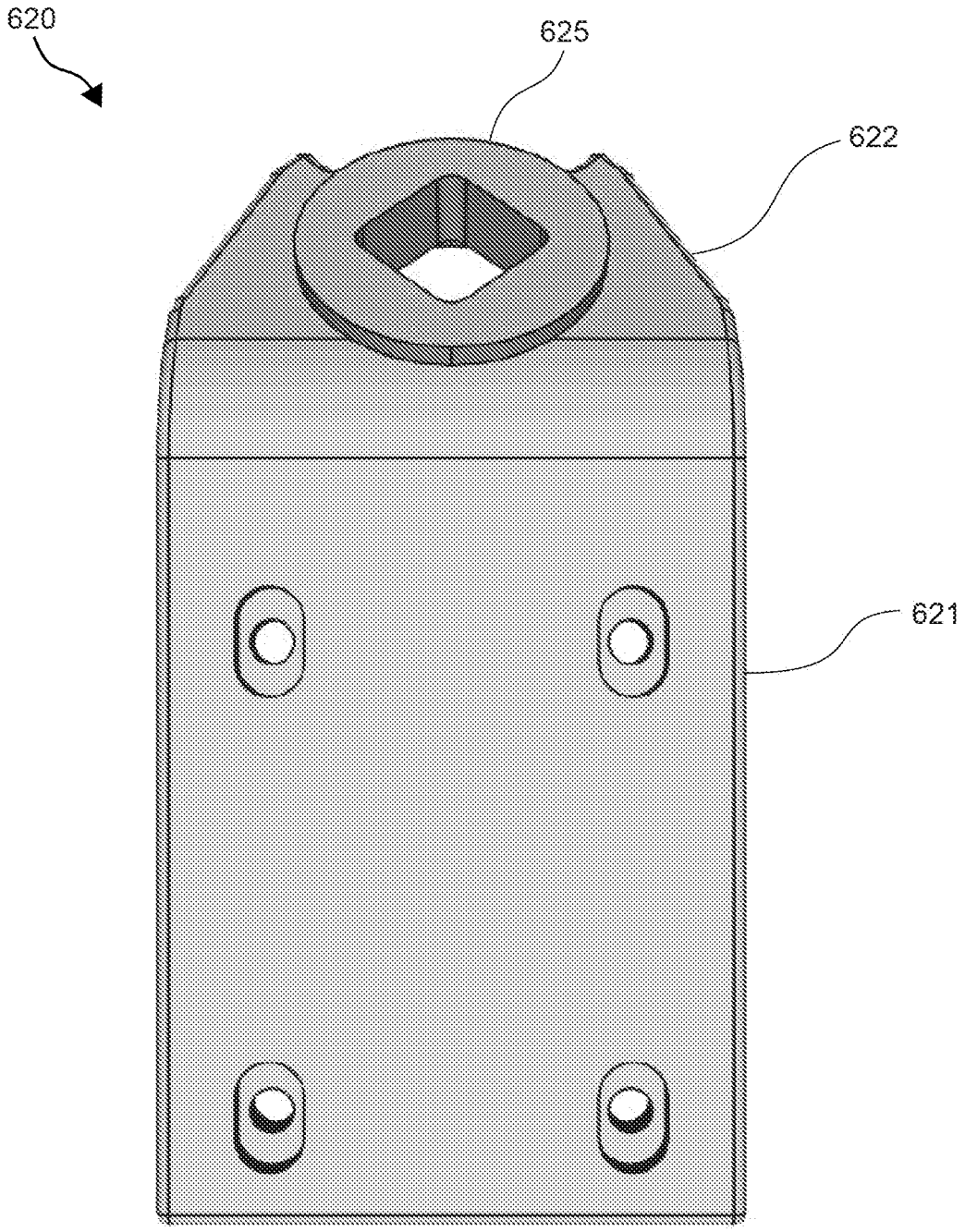
FIG. 24*c* is a front view of an embodiment of the pivoting plate of the front truck carrying member in FIG. 24*a*.
Figure 24D:
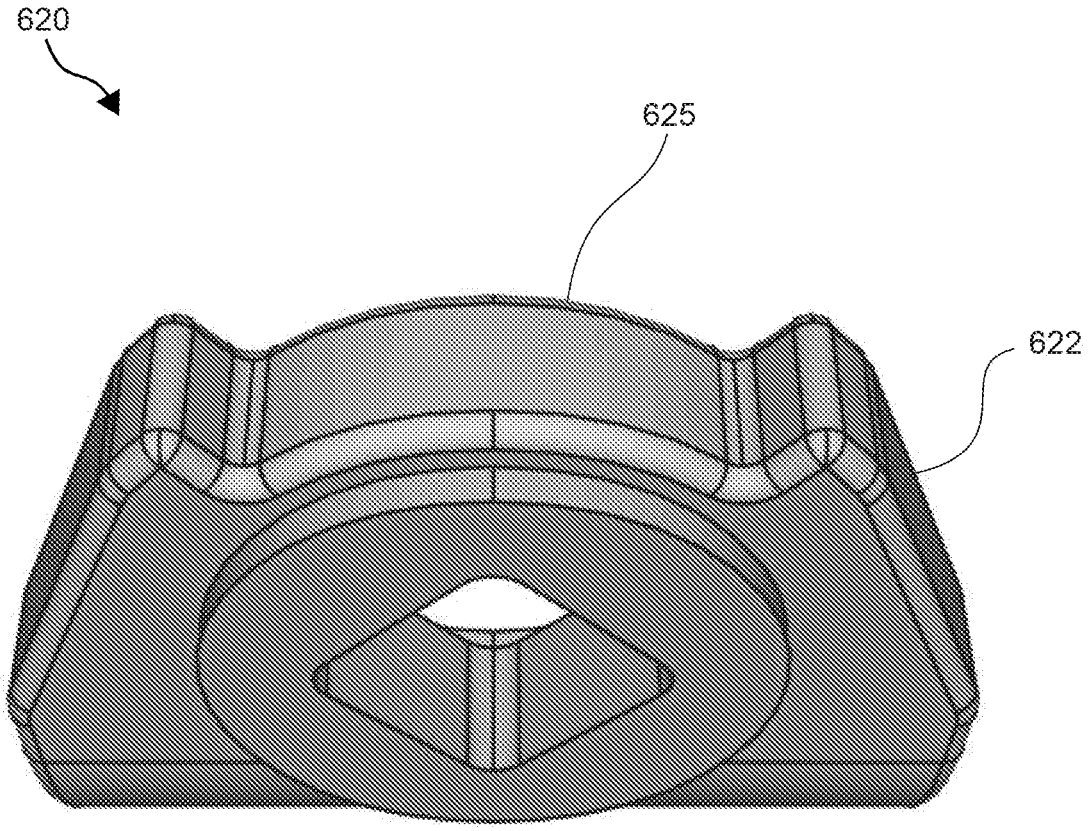
FIG. 24*d* is a front view of an embodiment of the pivoting plate of the front truck carrying member in FIG. 24*a*.
Figure 24E:
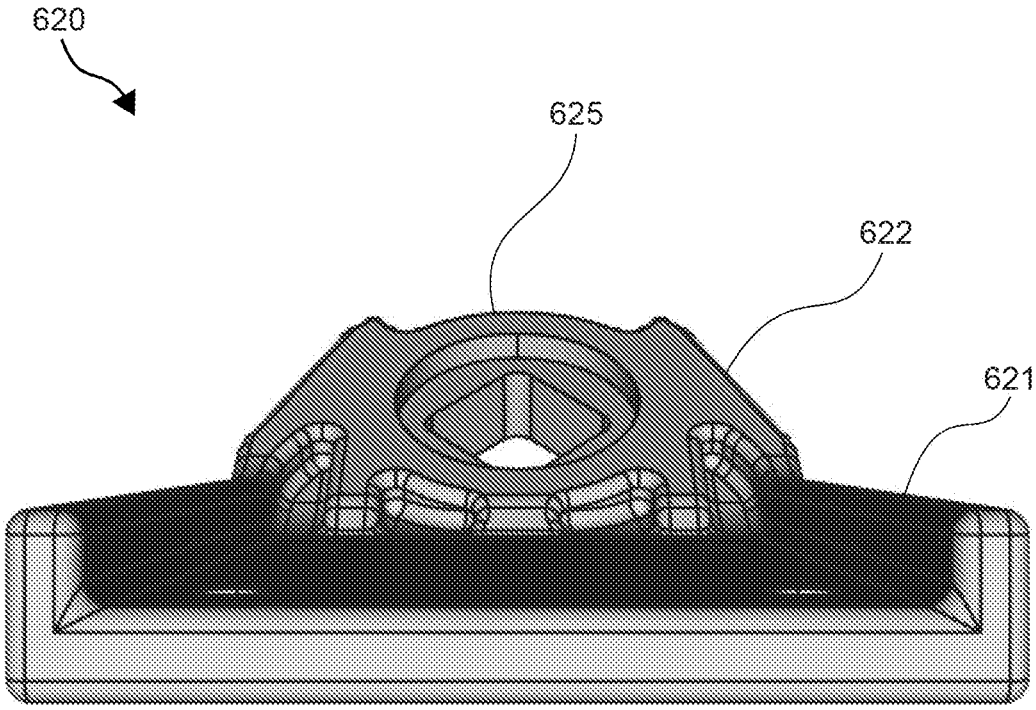
FIG. 24*e* is a rear view of an embodiment of the pivoting plate of the front truck carrying member in FIG. 24*a*.
Figure 24F:
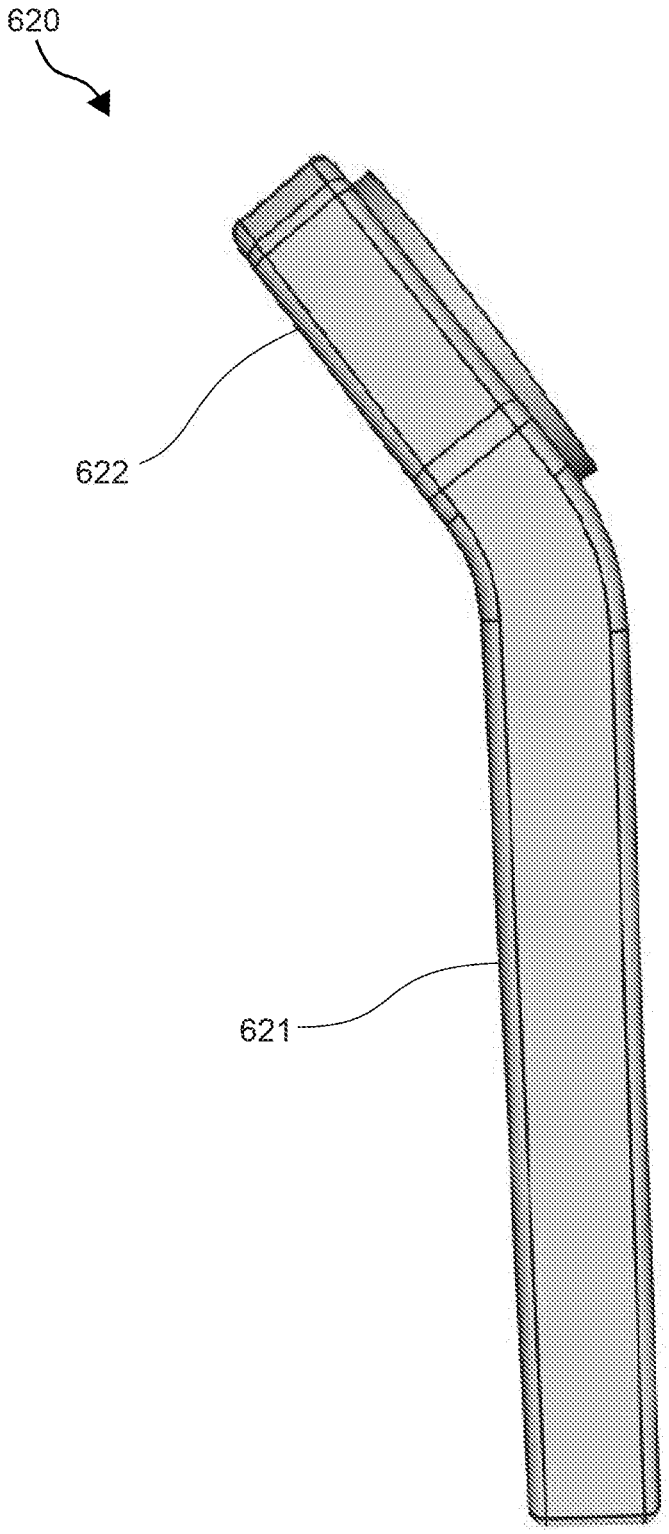
FIG. 24*f* is a right side view of an embodiment of the pivoting plate of the front truck carrying member in FIG. 24*a*.
Figure 25A:
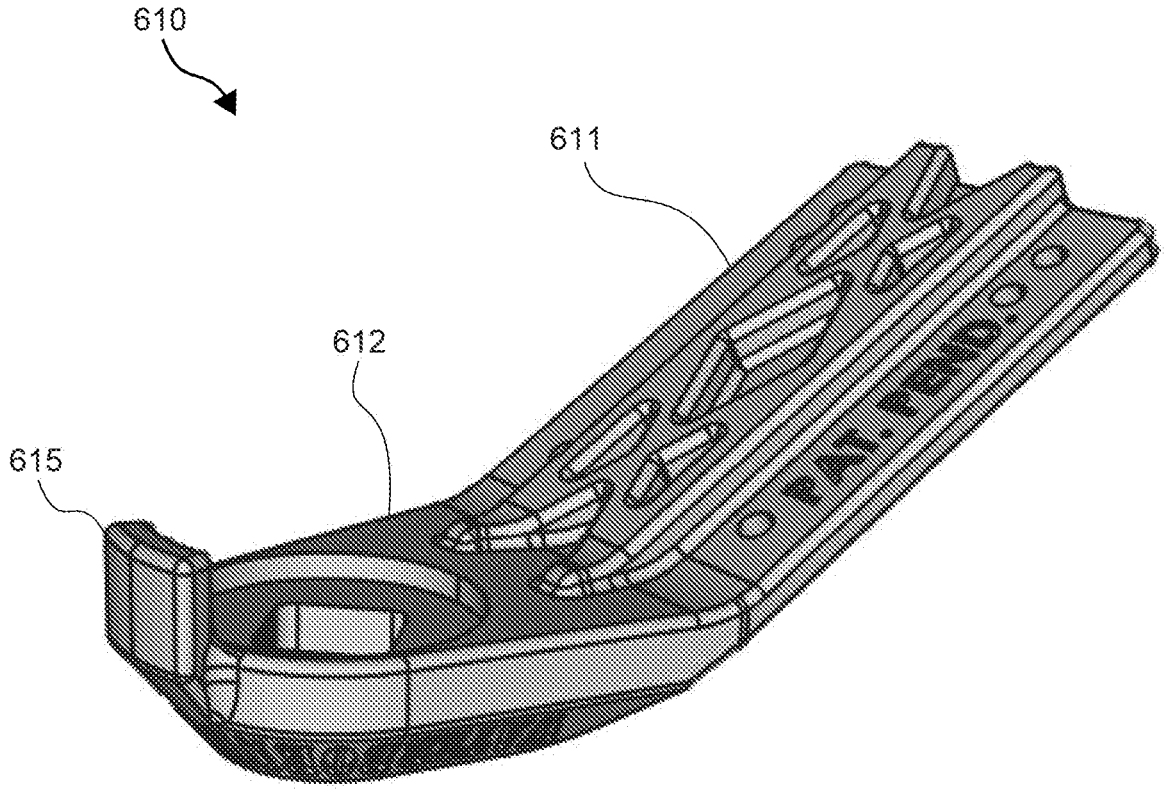
FIG. 25*a* is a bottom left side perspective view of an embodiment of the base plate of the front truck carrying member in FIG. 22*a*.
Figure 25B:
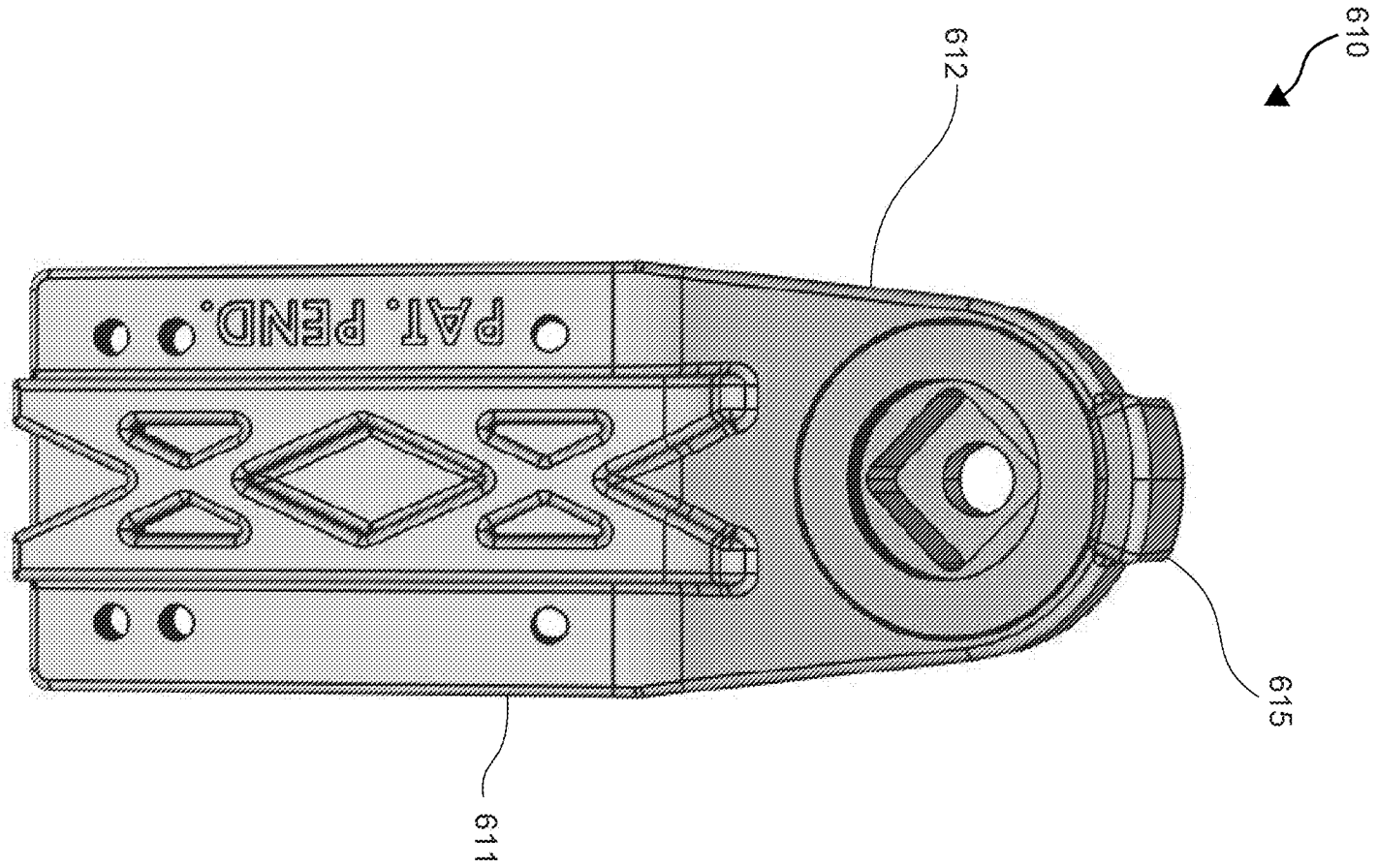
FIG. 25*b* is a bottom view of an embodiment of the base plate of the front truck carrying member in FIG. 25*a*.
Figure 25C:
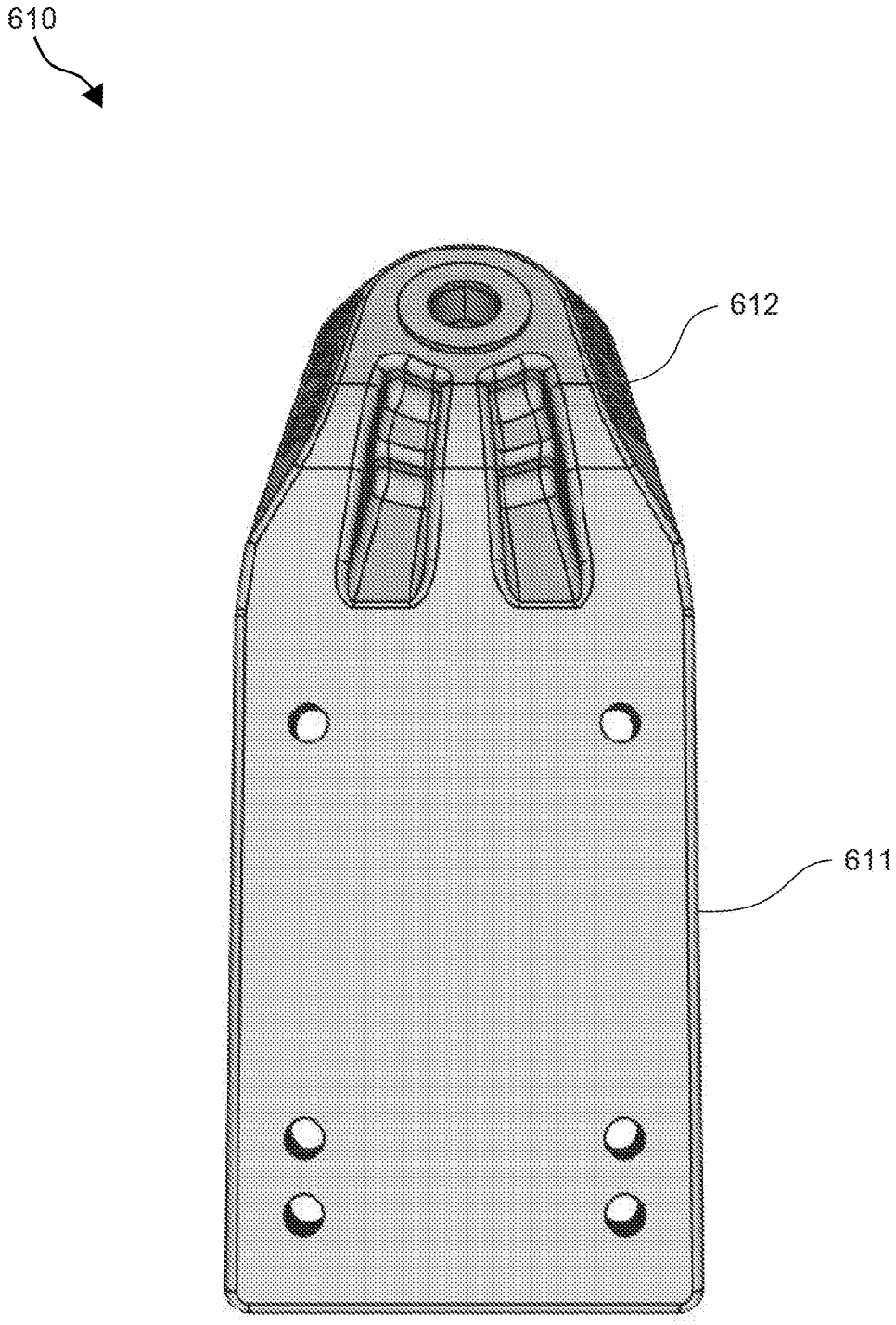
FIG. 25*c* is a top view of an embodiment of the base plate of the front truck carrying member in FIG. 25*a*.
Figure 25D:
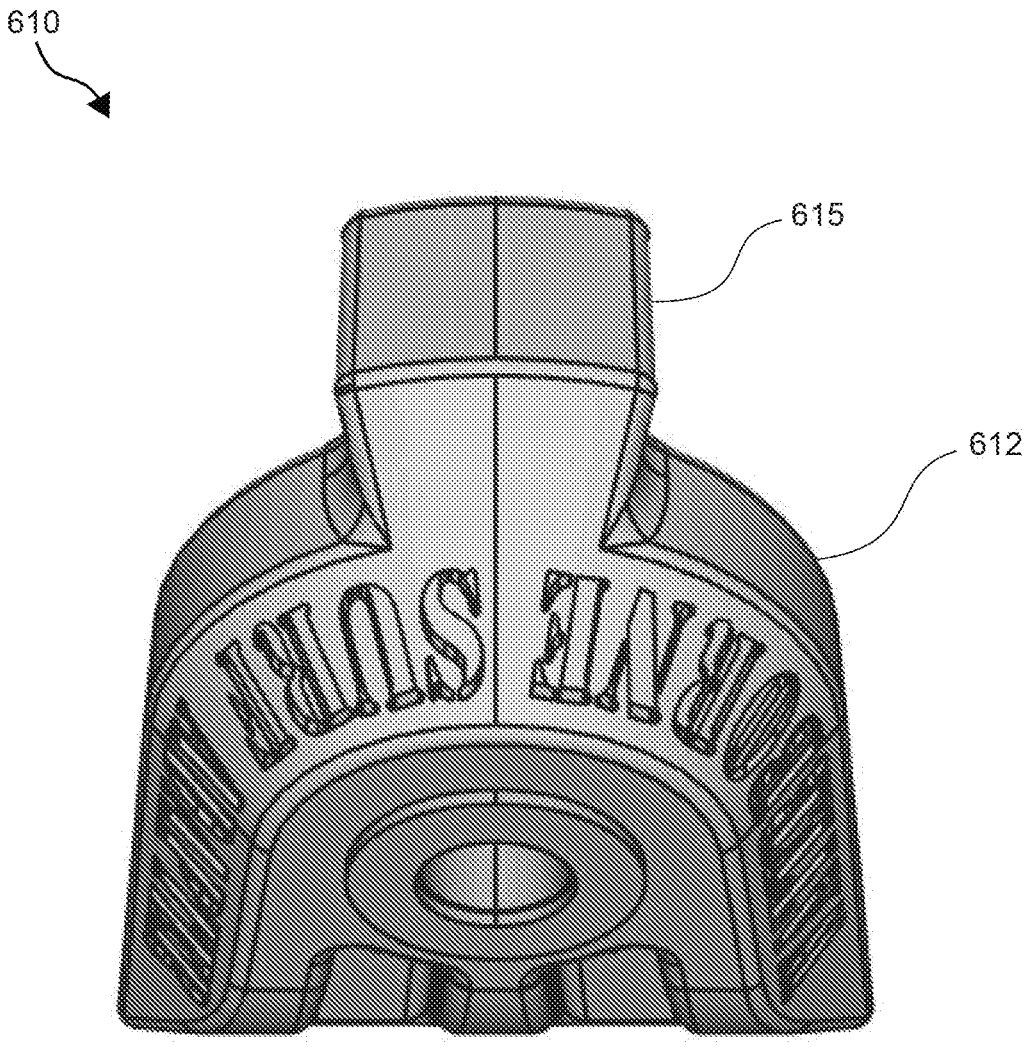
FIG. 25*d* is a front view of an embodiment of the base plate of the front truck carrying member in FIG. 25*a*.
Figure 25E:
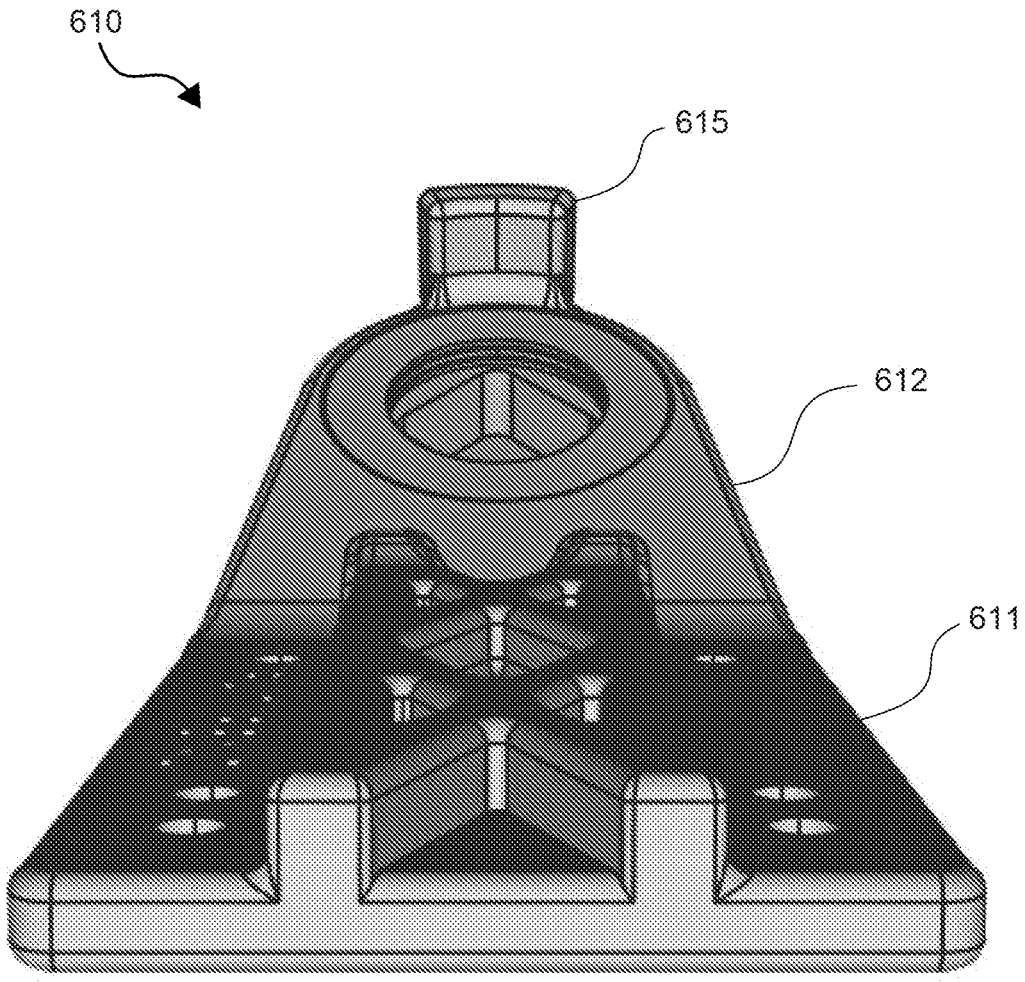
FIG. 25*e* is a rear view of an embodiment of the base plate of the front truck carrying member in FIG. 25*a*.
Figure 25F:
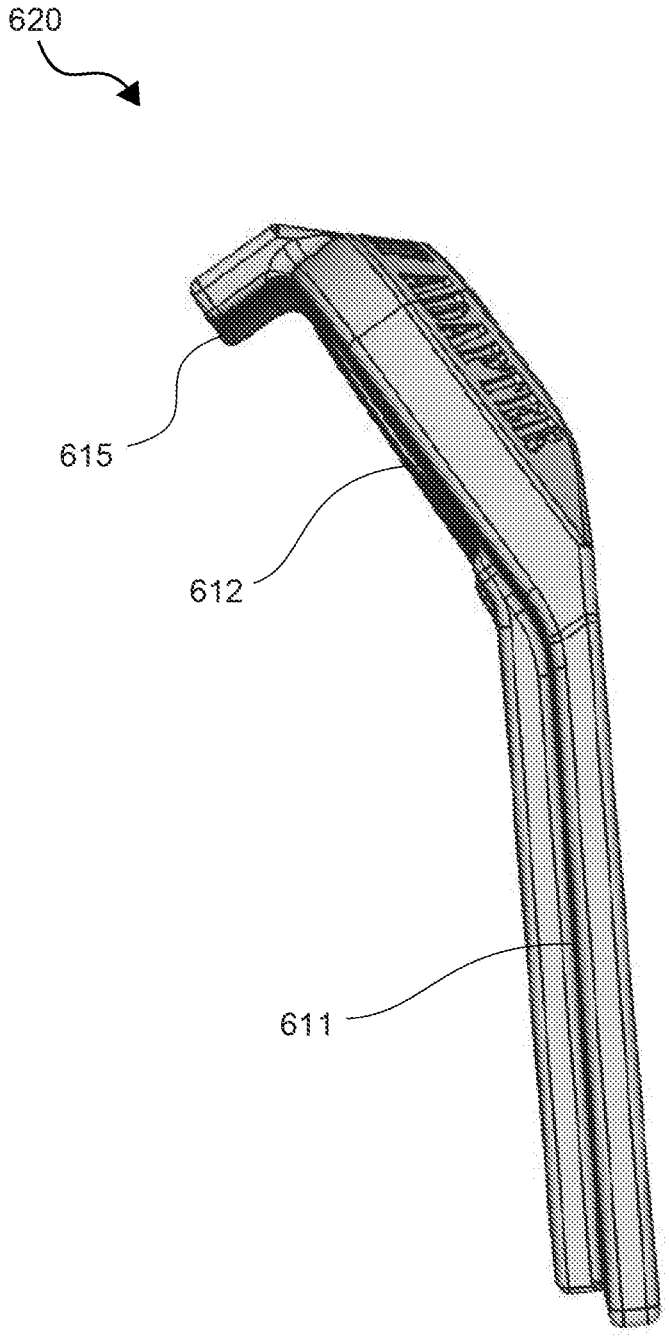
FIG. 25*f* is a right side view of an embodiment of the base plate of the front truck carrying member in FIG. 25*a*.
Figure 26A:
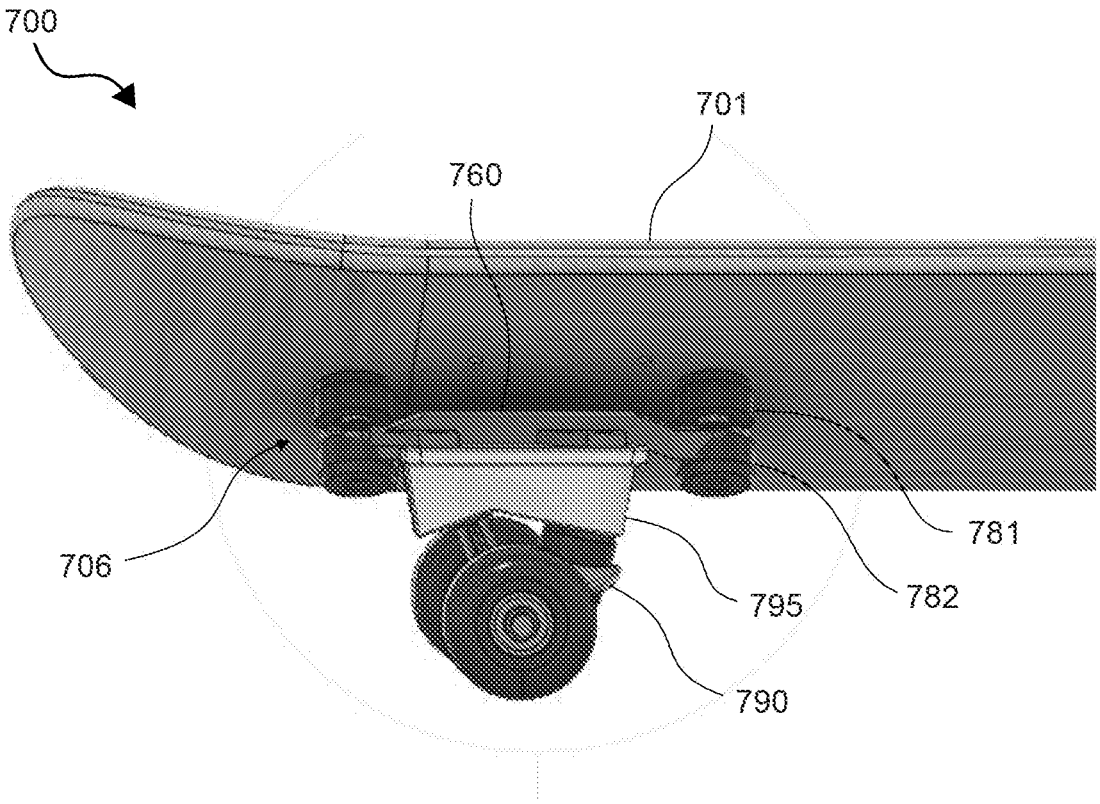
FIG. 26*a* is a bottom rear left side view of an embodiment of a rear truck carrying member.
Figure 26B:
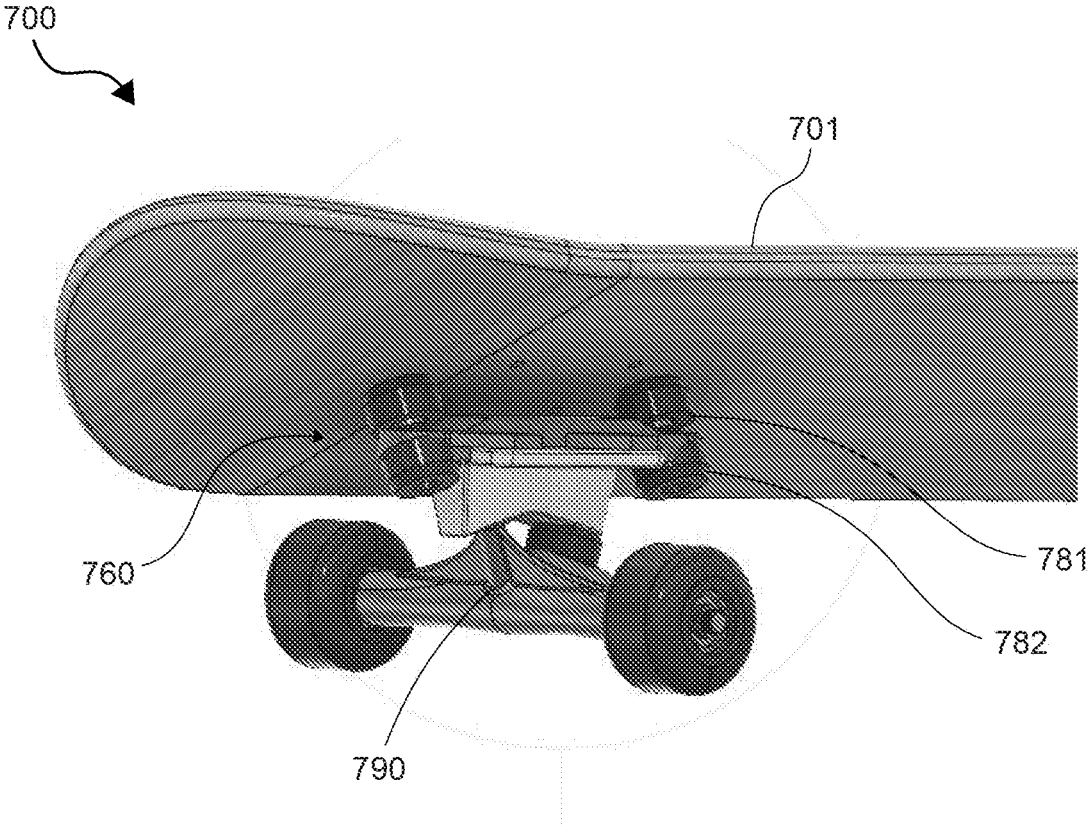
FIG. 26*b* is a bottom rear left view of the rear truck carrying member in FIG. 26*a*.
Figure 26C:
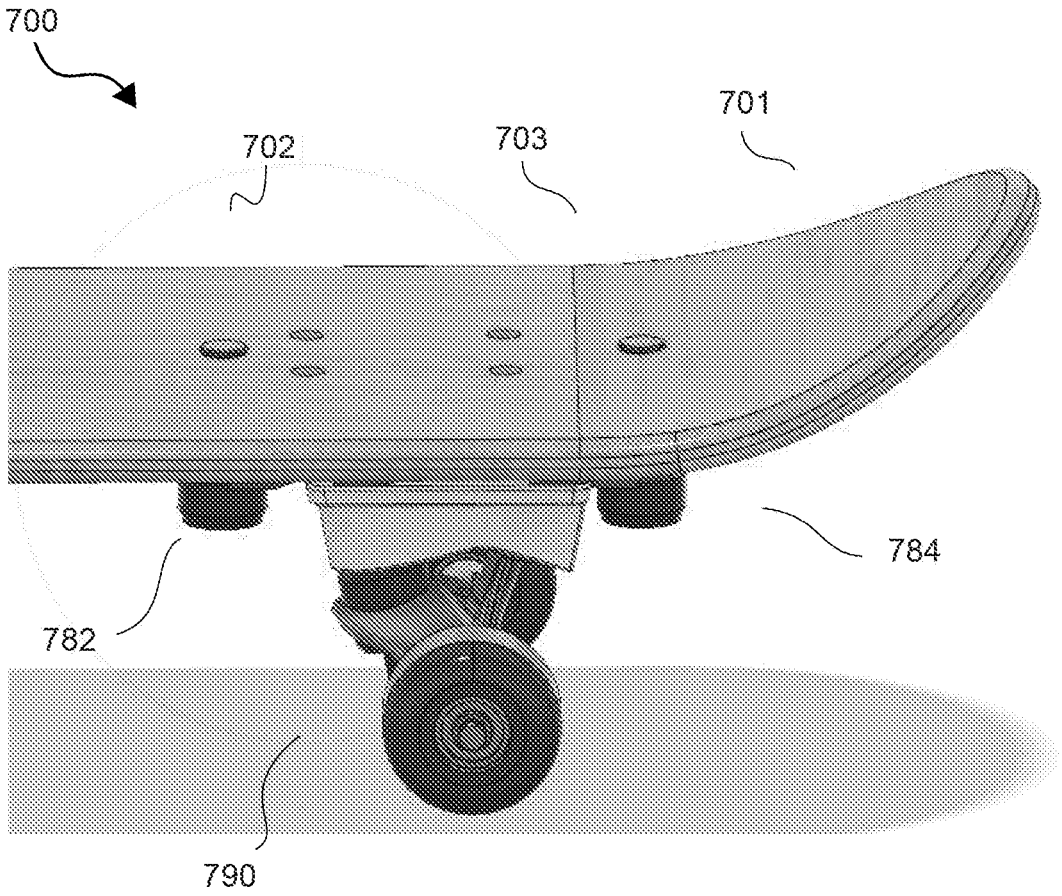
FIG. 26*c* is a right side perspective view of the rear truck carrying member in FIG. 26*a*.
Figure 26D:
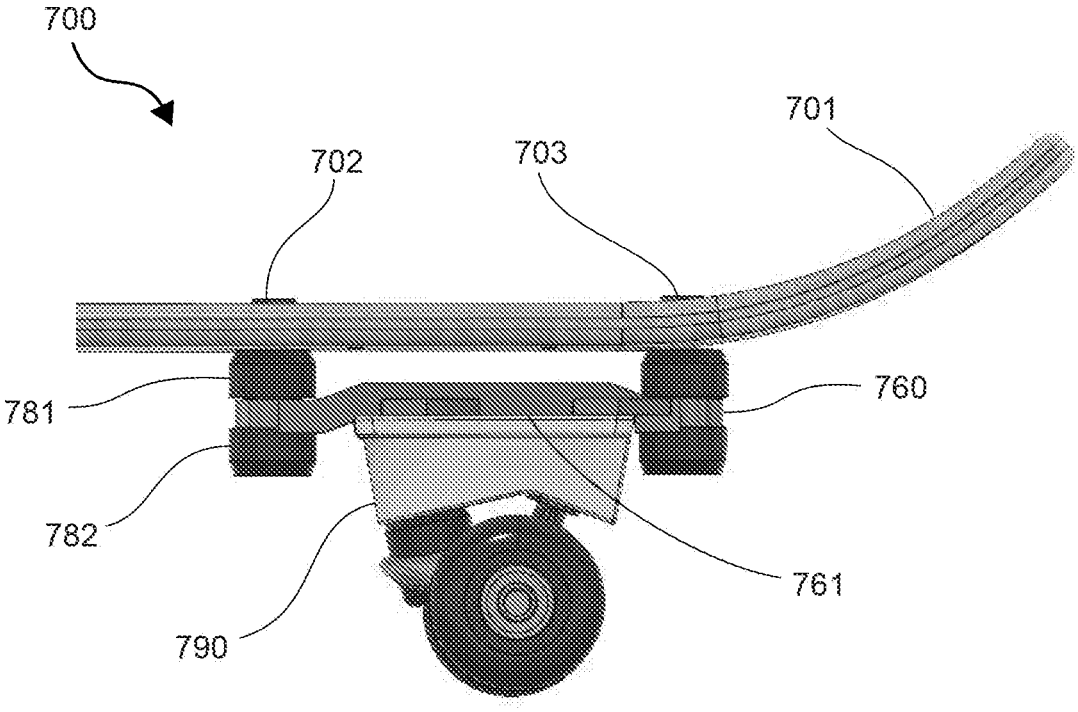
FIG. 26*d* is a right side view of the rear truck carrying member in FIG. 26*a*.
Figure 26E:
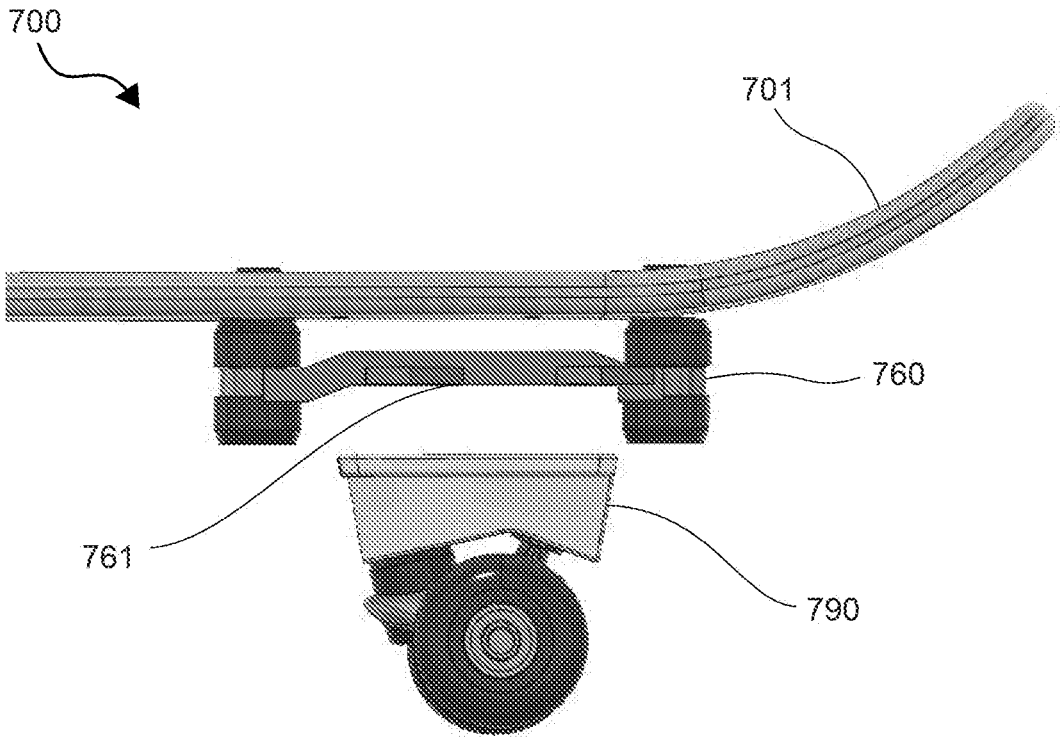
FIG. 26*e* is a right side view of the rear truck carrying member in FIG. 26*a* attached to a skateboard, detached from a truck.
Figure 26F:
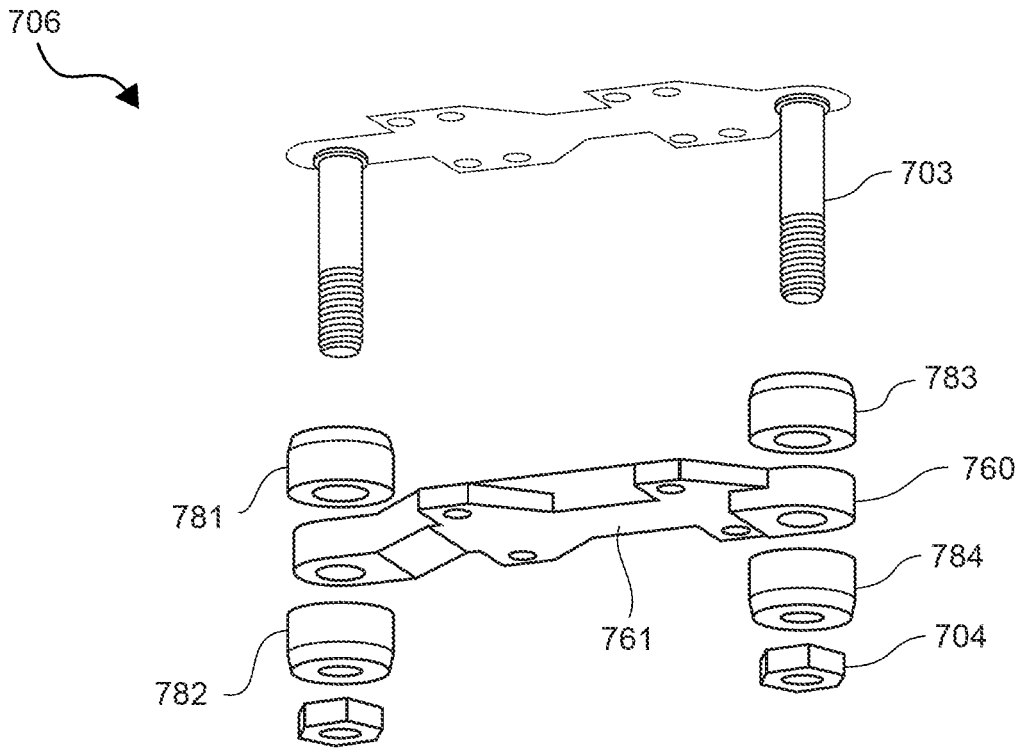
FIG. 26*f* is an exploded view of an embodiment of the rear truck carrying member in FIG. 26*a*.

FIG. 22*a* is a perspective view of an embodiment of a skateboard 600 having a deck 601, a front truck carrying member 605, a front truck 640, a rear truck carrying member 606, and a rear truck 690. The front truck carrying member 605 couples the front truck 640 to the deck 601, and the back truck carrying member 606 couples the rear truck 690 to the deck 601. FIG. 22*b* is a perspective view of an embodiment of the front and back truck carrying members (605 and 606) attached to a skateboard surface 601, without trucks. FIG. 22*c* is a side view of an embodiment of front and back truck carrying members (605 and 606) attached to a skateboard 601, without trucks.

FIG. 23 (*a-f*) shows a preferred embodiment of a front truck carrying member 605 having a base plate 610 and a pivoting plate 620. The pivoting plate 620 has one or more fasteners for coupling with a truck 640, while the base plate 610 has one or more fasteners for coupling with the skateboard deck 601. FIG. 23*a* is a right side view, FIG. 23*b* is a bottom left side perspective view, FIG. 23*c* is a bottom view, FIG. 23*d* is a top view, FIG. 23*e* is an exploded right side view, and FIG. 23*f* is an exploded right side perspective view, of an embodiment of the front truck carrying member 605.

The base plate 610 and pivoting plate 620 are coupled at a pivot 630 such that the pivoting plate 620 can turn with respect to the base plate 610. The pivot 630 has a flexible member 635 coupled with the pivoting plate 620 and base plate 610. The pivoting plate 620 has a recess sized and dimensioned to receive a first end of the flexible member 635. The base plate 610 also has a recess sized and dimensioned to receive an end of the flexible member 635. In preferred embodiments, the pivot further comprises a bolt 631 about which the base plate 610 and pivoting plate 620 pivot.

The base plate 610 has a mounting surface 611 for attaching a skateboard deck 601 and a pivoting surface 612 for coupling to the pivoting plate 620. Preferably, the mounting surface 611 and pivoting surface 612 of the base plate 610 form an obtuse angle. The pivoting plate 620 has a mounting surface 621 for attaching a truck 640 and a pivoting surface 622 for coupling to the base plate 610. Preferably, the mounting surface 621 and pivoting surface 622 of the pivoting plate 620 form an obtuse angle. In especially preferred embodiments, the obtuse angle of the base plate 610 is larger than the obtuse angle of the pivoting plate 620, such that the mounting surface 621 of the pivoting plate 720 extends downward from the pivoting surface 622 when the truck carrying member 605 is attached to a bottom surface of the skateboard 601. Contemplated downward angles are between 0 and 85 degrees, inclusive. In preferred embodiments, the downward angle is between 5 and 45 degrees, inclusive. In especially preferred embodiments, the pivoting plate 620 has a downward angle between 5 and 20 degrees relative to the base plate 610.

The pivot axis 250 is a trade-off between turn angle and lean angle. As used herein, "turn angle" refers to the degree of rotation of the wheel axle within a plane parallel to the skateboard. A "lean angle" refers to the degree of tilt of the board relative the wheel axle. Since a traditional skateboard truck's pivot axis 250 cannot be modified from its manufactured configuration, the downward angle between the pivoting plate 620 and the base plate 610 can advantageously and effectively modify the position of the conventional truck's pivot axis to thereby increase the skateboard's turn angle and decrease the lean angle. For example, if the pivoting plate 620 has 5 degree downward angle relative to the base plate 610, the pivot axis would be adjusted by 5 degrees, so the turn of the truck's pivot axis would be increased and its lean is decreased proportionally.

The flexible member 635 biases the pivoting plate 620 to a default position relative to the base plate 610. A preferred default position is where the pivoting plate 620 is at a center position relative to the base plate 610. The flexible member 635 mechanically locks the pivoting plate 620 to the base plate 610 to prevent rotation to a certain extent. To achieve this mechanical lock, contemplated flexible members have a non-cylindrical cross-section, including triangle, square, pentagonal, or an irregular shape, such that the pivoting plate 620 cannot rotate relative to the base plate 610 without changing the shape of the flexible member 635. However, if the torque is sufficient large, the flexible member 635 changes its shape. The change in the shape of the flexible member 635 in turn creates tension in the flexible member 635. The tension is released when flexible member 635 returns to its original shape. As such, the flexible member 635 has a tendency to return to its normal shape due to its elastic nature.

Contemplated flexible members 635 can be made with any suitable material, including man-made polymer (e.g., urethane, isoprene, resilient plastic), a natural polymer (e.g., rubber), or a mixture of man-made and natural polymers (e.g., silicone rubber). In preferred embodiments, the flexible member 635 is sufficiently flexible to allow the pivoting plate 620 to rotate at least 15 degrees and as much as 90 degrees relative to the base plate 610. In especially preferred embodiments, the flexible member 635 comprises one or more cylindrical bushings which can be securely fastened to the pivoting plate 620 and base plate 610. It is contemplated that the flexible members 635 made of an elastic material (e.g., urethane) can provide resistance that is gentle and soft, which translates to a smoother transition during turning. It is further contemplated that the resistance can increase exponentially as the angle of the pivot increases, which gives the rider more control of the skateboard during turning and transitioning. In some embodiments, it is contemplated that the flexible member is sufficiently rigid to limit the range of motion of the pivoting place to within 45 degrees.

In preferred embodiments, the base plate 610 further comprises a protrusion 615 that is sized and dimensioned to move within the notch 625 in the pivoting plate 620. All degrees of motion of the pivoting plate 620 are contemplated. In preferred embodiments, due to the limit imposed by notch 625, the pivoting plate 620 has a range of motion of less than or equal to 45 degrees clockwise and counterclockwise, relative to the base plate 610. In other embodiments, the pivoting member 620 has a range of motion of less than or equal to 30 degrees clockwise and counterclockwise, due to the limit imposed by notch 625.

It is contemplated that the pivot 630 provides a smooth transition between one position and another when pivoting, without any catching (i.e., abrupt disruption) or friction that likely to exist in dual pivot trucks especially with springs. As a result, the rider experiences a smooth sensation as he shifts weight between toes and heals, as the board rolls over from side to side, as if resting on a cylinder.

FIG. 24 (*a-f*) shows a preferred embodiment a pivoting plate 620 of a front truck carrying member 605. The pivoting plate 620 further comprises a notch 625. FIG. 24*a* is a perspective bottom left side view, FIG. 24*b* is a bottom view, FIG. 24*c* is a front view, FIG. 24*d* is a front view, FIG. 24*e* is a rear view, and FIG. 24*f* is a right side view, of an embodiment of the pivoting plate 620.

FIG. 25 (*a-f*) shows a preferred embodiment a base plate 610 of a front truck carrying member 605. The pivoting surface 612 of the base plate 610 further comprises a protrusion 615. FIG. 25*a* is a bottom left side perspective view, FIG. 25*b* is a bottom view, FIG. 25*c* is a top view, FIG. 25*d* is a front view, FIG. 25*e* is a rear view, and FIG. 25*f* is a right side view of an embodiment of the base plate 610.

FIG. 26 shows another embodiment of a rear truck carrying member 706 that couples a truck 790 to a skateboard deck 701, comprising a pivoting plate 760, without a base plate. FIG. 26*a* is a bottom rear left side view of an embodiment of the rear truck carrying member 706. FIG. 26*b* is a bottom rear left view of an embodiment of the rear truck carrying member 706 in a tilting position. FIG. 26*c* is a right side perspective view of an embodiment of the rear truck carrying member 706 attached to a skateboard 701. FIG. 26*d* is a right side view of an embodiment of the rear truck carrying member 706 attached to a truck 790 and a skateboard 701. FIG. 26*e* is a right side view of an embodiment of the rear truck carrying member 706 attached to a skateboard 701, detached from a truck 790. FIG. 26*f* is an exploded view of an embodiment of the rear truck carrying member 706.

The pivoting plate 760 has a mounting surface 761 for attaching to a truck 790. The pivoting plate 760 can be attached to a skateboard deck 701 using one or more fasteners (702 and 703). In preferred embodiments, the fasteners comprise one or more flexible members 781-784 that allow the pivoting plate 760 to tilt. In especially preferred embodiments, the flexible members 781-784 have sufficient flexibility to allow the pivoting plate 760 to tilt at least 45 degrees. Contemplated flexible members 781-784 include cylindrical bushings.

Thus, specific devices and methods of skateboard truck carrying members have been disclosed. It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A truck carrying member that couples a truck to a skateboard, the truck comprising a wheel axle, comprising:

a base plate having a first mounting surface for coupling with the skateboard and a first pivoting surface, wherein the first mounting surface and the first pivoting surface form a first obtuse angle;

a pivoting plate having a second mounting surface for coupling with the truck and a second pivoting surface, wherein the second mounting surface and second pivoting surface form a second obtuse angle;

wherein the first pivoting surface and the second pivoting surface are rotatably coupled at a pivot comprising a flexible member that biases the pivoting plate from an off-center position to a center position relative to a longitudinal axis of the base plate; and wherein the second obtuse angle is less than the first obtuse angle such that the second mounting surface extends downward from the skateboard when the truck carrying member is attached to a bottom surface of the skateboard.

2. The truck carrying member of claim 1, wherein the pivoting plate has a first recess sized and dimensioned to receive a first end of the flexible member.

3. The truck carrying member of claim 2, wherein the base plate has a second recess sized and dimensioned to receive a second end of the flexible member.

4. The truck carrying member of claim 3, wherein the flexible member mechanically locks with the pivoting and base plates to prevent rotation with respect to the first end and second end of the flexible member, respectively.

5. The truck carrying member in claim 4, wherein the flexible member has a non-cylindrical cross-section.

6. The carrying member of claim 1, wherein the pivot further comprises a bolt about which the base plate and pivoting plate pivot.

7. The carrying member of claim 1, the flexible member is sufficiently flexible to allow the pivoting plate to rotate at least 15 degrees relative to the base plate.

8. The carrying member of claim 1, wherein, in the default position, the pivoting plate is at a center position relative to the base plate.

9. The carrying member of claim 1, wherein the flexible member comprises a bushing.

10. The carrying member of claim 1, wherein the flexible member comprises a polymer.

11. The truck carrying member of claim 1, wherein the second mounting surface extends downward between 5 degree to 45 degrees, inclusive, from the bottom surface of the skateboard, when the truck carrying member is attached to a bottom surface of the skateboard.

12. The truck carrying member of claim 1, wherein the truck carrying member increases the truck's turn angle by 5 to 45 degrees, inclusive, and decreases the truck's lean angle by 5 to 45 degrees, inclusive, compared to when the truck is used without the truck carrying adapter.

13. The carrying member of claim 1, wherein:

the second pivoting surface of the pivoting plate further comprises a notch; and the first pivoting surface of the base plate further comprises a protrusion that is sized and dimensioned to move within the notch.

14. The carrying member of claim 13, wherein the pivoting member has a range of motion of less than 45 degrees clockwise and counterclockwise.

15. The carrying member of claim 13, wherein the pivoting plate is capable of pivoting such that the skateboard can angle to face a point around which a user is turning.

16. The carrying member of claim 13, wherein the pivot provides a smooth transition when pivoting.

17. A truck carrying member that couples a truck to a skateboard, comprising:

a pivoting plate having a mounting surface for attaching a truck;

first and second fasteners for attaching the pivoting plate to a skateboard or a base plate; and wherein the first and second fasteners comprise first and second flexible members that allow the pivoting plate to tilt.

18. The truck carrying member of claim 17, wherein the first and second flexible members comprise a first bushing and a second bushing, respectively.

19. The truck carrying member of claim 17, wherein the first and second flexible members have sufficient flexibility to allow the pivoting plate to tilt at least 10 degrees, inclusive.

* * * * *